US009268296B2

(12) United States Patent
Itabashi et al.

(10) Patent No.: US 9,268,296 B2
(45) Date of Patent: Feb. 23, 2016

(54) IMAGE FORMING APPARATUS AND CARTRIDGE THEREFOR

(71) Applicant: Brother Kogyo Kabushiki Kaisha, Nagoya-shi, Aichi-ken (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/613,958

(22) Filed: Feb. 4, 2015

(65) Prior Publication Data

US 2015/0147091 A1 May 28, 2015

Related U.S. Application Data

(62) Division of application No. 13/628,168, filed on Sep. 27, 2012, now Pat. No. 8,965,222.

(30) Foreign Application Priority Data

Sep. 29, 2011 (JP) ..... 2011-214655

(51) Int. Cl.
*G03G 21/16* (2006.01)
*G03G 21/18* (2006.01)

(52) U.S. Cl.
CPC ..... *G03G 21/1652* (2013.01); *G03G 21/1676* (2013.01); *G03G 21/1867* (2013.01); *G03G 21/1878* (2013.01); *G03G 21/1896* (2013.01)

(58) Field of Classification Search
CPC ..... G03G 21/1821; G03G 21/1867
See application file for complete search history.

(56) References Cited

U.S. PATENT DOCUMENTS 7,085,509 B2 8/2006 Kubota et al.
7,174,113 B2 2/2007 Kubota et al.

(Continued)

FOREIGN PATENT DOCUMENTS

CN 201464807 U 5/2010
EP 1542096 A1 6/2005

(Continued)

OTHER PUBLICATIONS

European Search Report issued in European Patent Application No. 12186091.0 mailed on Jan. 2, 2014.

(Continued)

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus and a cartridge to be used therein are provided. The image forming device includes a main casing, a CPU as a judgment unit, and a main electrode. The cartridge accommodating therein a toner is attachable to and detachable from the main casing, and has a moving member and a cartridge electrode electrically connectable to the main electrode. The CPU is configured to judge assembly or non-assembly of the cartridge with respect to the main casing and to judge whether or not the assembled cartridge is a new cartridge. The moving member is movable by a predetermined moving amount to permit the cartridge electrode to be movable. As a result of a movement of the main electrode in accordance with the movement of the cartridge electrode, the CPU determines that the assembled cartridge is a new cartridge.

12 Claims, 11 Drawing Sheets

(56) References Cited

U.S. PATENT DOCUMENTS

| | | | | |
|---|---|---|---|---|
| 7,978,997 | B2 | 7/2011 | Tokuda | |
| 2005/0135832 | A1 | 6/2005 | Kubota et al. | |
| 2006/0110181 | A1 | 5/2006 | Kubota et al. | |
| 2007/0059018 | A1 * | 3/2007 | Tokuda | G03G 15/0806 399/90 |
| 2011/0211866 | A1 | 9/2011 | Hashimoto | |
| 2011/0243578 | A1 | 10/2011 | Ukai et al. | |
| 2011/0293294 | A1 | 12/2011 | Eto | |
| 2013/0084083 | A1 | 4/2013 | Itabashi et al. | |
| 2013/0084084 | A1 | 4/2013 | Itabashi et al. | |
| 2015/0153675 | A1 | 6/2015 | Itabashi et al. | |

FOREIGN PATENT DOCUMENTS

| | | | | |
|---|---|---|---|---|
| JP | H11-282324 | A | 10/1999 | |
| JP | EP 1542096 | A1 * | 6/2005 | G03G 21/1853 |
| JP | 2007-079284 | A | 3/2007 | |

OTHER PUBLICATIONS

European Search Report issued in European Patent Application No. 12186096.9 mailed on Jan. 2, 2014.

European Search Report issued in European Patent Application No. 12186071.2 mailed on Jan. 2, 2014.

Non-final Office Action received in corresponding U.S. Appl. No. 13/628,220 dated Mar. 5, 2014.

Non-Final Office Action received in corresponding U.S. Appl. No. 13/628,526 mailed May 21, 2014.

Oct. 17, 2014—(US) Notice of Allowance—U.S. Appl. No. 13/628,526.

Jul. 21, 2015—(US) Non-Final Office Action—U.S. Appl. No. 14/613,814.

* cited by examiner

IMAGE FORMING APPARATUS AND CARTRIDGE THEREFOR

CROSS REFERENCE TO RELATED APPLICATION

This application is a divisional application of prior U.S. application Ser. No. 13/628,168, filed Sep. 27, 2012, which claims priority from Japanese Patent Application No. 2011-214655 filed Sep. 29, 2011. The entire content of the priority application is incorporated herein by reference. The present application closely relates to a co-pending U.S. patent application Ser. No. 13/628,220, filed Sep. 27, 2012 (based on Japanese patent application No. 2011-214609 filed Sep. 29, 2011) and another co-pending U.S. patent application Ser. No. 13/628,526, filed Sep. 27, 2012 (based on Japanese patent application No. 2011-214625 filed Sep. 29, 2011) which are incorporated herein by reference.

TECHNICAL FIELD

The present invention relates to an electro-photographic type image forming apparatus, and to a cartridge to be used in the image forming apparatus.

BACKGROUND

As an electro-photographic type image forming apparatus, a printer including a photosensitive body and a developing cartridge configured to supply toner to the photosensitive body is known.

A conventional printer is provided with a detection device for detecting information of the developing cartridge assembled therein, for example, for detecting whether or not the cartridge is a brand new cartridge.

Japanese Patent Application Publication No. 2007-79284 discloses an integral detection structure having a detection projection and a feed electrode. The detection projection is made from an electrically conductive resin and is provided at a side surface of the developing cartridge. The projection is in abutment with an actuator in a main casing. The feed electrode is configured to abut on a feed electrode in the main casing.

The detection structure is covered by a gear cover, and is irreversibly displaceable from a new cartridge position to an old cartridge position. The detection projection and the feed electrode are accommodated in the gear cover in case of the new cartridge position, and these are exposed to an outside through an opening of the gear cover in case of the old cartridge position.

SUMMARY

According to the detection structure disclosed in the publication, the detection projection and the feed electrode are provided integrally with each other, and the detection projection is abutted on the actuator while the feed electrode is abutted on the feed electrode of the main casing at the old cartridge position.

Therefore, high positioning accuracy is required to satisfy both positioning of the detection projection relative to the actuator and another positioning of the feed electrode relative to the feed electrode of the main casing.

Accordingly, if the developing cartridge is not sufficiently accommodated in the printer, positioning accuracy between the detection projection and the actuator and between the feed electrode and the feed electrode of the main casing may be degraded. For example, there may be a case that the actuator is out of contact with the detection projection while the feed electrodes are in contact with each other. In the latter case, erroneous detection occurs that old cartridge is accommodated in spite of the accommodation of a brand new cartridge.

It is therefore an object of the present invention to provide an image forming apparatus and a cartridge to be accommodated therein, the image forming apparatus capable of accurately detecting a condition of the accommodated cartridge.

In order to attain the above and other objects, the present invention provides an image forming apparatus including: a main casing; a cartridge; a main electrode; a moving member; and a judgment unit. The cartridge is configured to be attached to and detached from the main casing and to accommodate therein developing agent. The cartridge has a cartridge electrode configured to receive an electric power from the main casing. The main electrode is configured to be positioned in confrontation with the cartridge electrode in a confronting direction and electrically connectable to the cartridge electrode. The main electrode is configured to be moved in the confronting direction. The moving member is provided to face the cartridge electrode and configured to be moved in a moving direction by a predetermined moving amount. The moving member is configured to move the cartridge electrode to a first position where the cartridge electrode is in contact with the main electrode and to a second position moved from the first position in the confronting direction. The judgment unit is configured to judge that a cartridge attached to the main casing is a new cartridge if the main electrode is moved in accordance with a movement of the cartridge electrode between the first position and the second position.

According to another aspect, the present invention provides a cartridge including: a cartridge frame; a drive input portion; a cartridge electrode; and a moving member. The cartridge frame is configured to accommodate therein developing agent. The cartridge frame includes a first side wall and a second side wall spaced away therefrom and in confrontation therewith in a confronting direction. The drive input portion is provided at one of the first side wall and the second side wall and configured to receive an external driving force. The cartridge electrode is provided at the second side wall and configured to receive an external electric power. The cartridge electrode is configured to be moved to a first position where the cartridge electrode receives the external electric power and to a second position moved from the first position in the confronting direction. The moving member is provided at the second side wall and provided to face the cartridge electrode. The moving member is configured to be moved in a moving direction by a predetermined moving amount in response to a reception of the external driving force into the moving member as a result of an input of the external driving force into the drive input portion. The moving member is configured to move the cartridge electrode to the first position and to the second position.

According to still another aspect, the present invention provides a cartridge including: a cartridge frame; a drive input portion; a cartridge electrode; and a moving member. The cartridge frame has a developing agent accommodating portion configured to accommodate developing agent therein. The cartridge frame includes a first side wall and a second side wall spaced away therefrom and in confrontation therewith in a confronting direction. The drive input portion is disposed at a position opposite to the developing agent accommodating portion with respect to one of the first side wall and the second side wall and configured to receive an external driving force. The cartridge electrode is disposed at a position opposite to the developing agent accommodating portion with respect to the second side wall and configured to receive an external electric power. The cartridge electrode is configured to be moved to a first position where the cartridge electrode receives the external electric power and to a second position moved from the first position in the confronting direction. The moving member is disposed at a position opposite to the developing agent accommodating portion with respect to the second side wall and provided to face the cartridge electrode. The moving member is configured to be moved in a moving direction by a predetermined moving amount in response to a reception of the external driving force into the moving member as a result of an input of the external driving force into the drive input portion. The moving member is configured to move the cartridge electrode from the first position to the second position and then from the second position to the first position.

BRIEF DESCRIPTION OF THE DRAWINGS

In the drawings;

FIGS. 5A and 5B are partial perspective views of the developing cartridge for description of movement of a cartridge electrode, which is a component of the developing cartridge of FIG. 3, in a new cartridge detecting operation; and in which FIG. 5A shows a state of a warm-up operation where the cartridge electrode is at a second position; and FIG. 5B shows a state after the warm-up operation where the cartridge electrode is at a first position;

FIGS. 6A and 6B are views for description of movement of the cartridge electrode, a main electrode, and an actuator in the new cartridge detecting operation; and in which FIG. 6A shows the state of the warm-up operation where the cartridge electrode is at the second position, the main electrode is at an advanced position, and the actuator is at a light transmitting position, and FIG. 6B shows the state after the warm-up operation where the cartridge electrode is at the first position, the main electrode is at a retracted position, and the actuator is at a light shielding position;

FIGS. 7A and 7B are views for description of movement of the cartridge electrode, the main electrode, and the actuator in the new cartridge detecting operation; and in which FIG. 7A shows the state of the warm-up operation where the cartridge electrode is at the second position, the main electrode is at the advanced position, and the actuator is at the light transmitting position, and FIG. 7B shows the state after the warm-up operation where the cartridge electrode is at the first position, the main electrode is at the retracted position, and the actuator is at the light shielding position;

FIGS. 8A and 8B are partial perspective views of a developing cartridge according to a second embodiment of the present invention for description of movement of a cartridge electrode, which is a component of the developing cartridge, in a new cartridge detecting operation; and in which FIG. 8A shows a state prior to a warm-up operation where the cartridge electrode is at a second position and FIG. 8B shows a state after the warm-up operation where the cartridge electrode is at a first position;

FIGS. 9A and 9B are perspective views of a moving member which is a component of a developing cartridge according to a third embodiment of the present invention; and in which FIG. 9A is a perspective view as viewed from a right side, and FIG. 9B is a perspective view as viewed from a left side;

FIGS. 9C-1 through 9C-3 are views for description of movement of the moving member in a new cartridge detecting operation, and in which FIG. 9C-1 shows a state prior to a warm-up operation where a cartridge electrode, which is a component of the developing cartridge according to the third embodiment, is in confrontation with a first recessed region of a recessed portion of the moving member, FIG. 9C-2 shows a state of the warm-up operation where the cartridge electrode is seated on a projection of the moving member, and FIG. 9C-3 shows a state after the warm-up operation where the cartridge electrode is in confrontation with a second recessed region of the recessed portion of the moving member; and FIGS. 10A through 10C are views for description of movement of the cartridge electrode, a main electrode and an actuator in the new cartridge detecting operation; and in which FIG. 10A shows a state prior to accommodation of the developing cartridge according to the third embodiment where the main electrode is at an advanced position and the actuator is at a first light transmitting position, FIG. 10B shows a state prior to the warm-up operation after accommodation of the developing cartridge where the cartridge electrode is at a first position, the main electrode is at a reference position and the actuator is at a light shielding position, and FIG. 10C shows a state of the warm-up operation where the cartridge electrode is at a second position, the main electrode is at a retracted position and the actuator is at a second light transmitting position.

DETAILED DESCRIPTION

A color printer as an image forming apparatus according to a first embodiment of the present invention will be described with reference to FIGS. 1 through 7B. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a left side and a right side are a front side and a rear side, respectively.

1. Overall Structure of Color Printer

Figure 1:
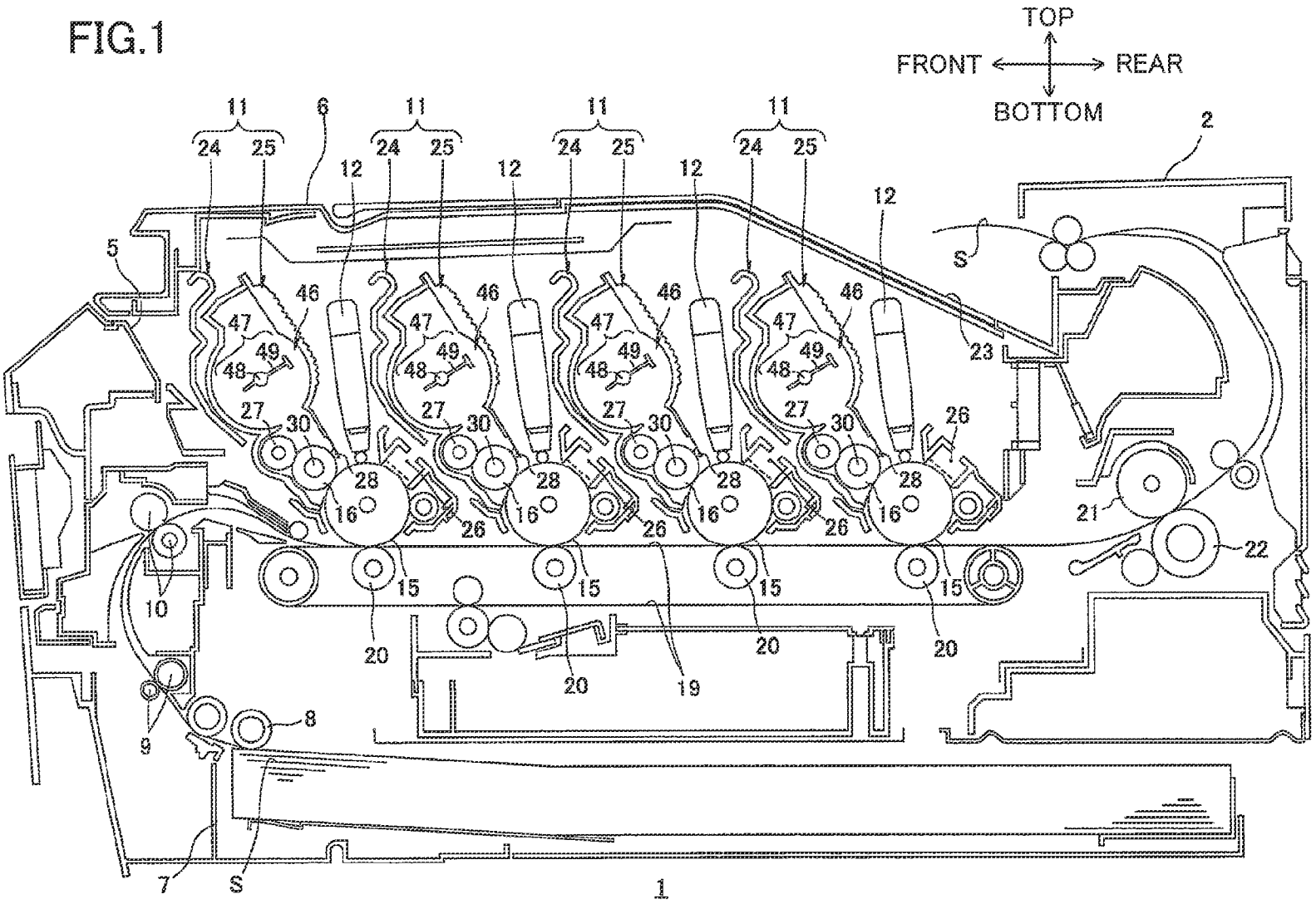
FIG. 1 is a cross-sectional view of a printer according to a first embodiment of the present invention.

Referring to FIG. 1, the printer 1 is a horizontal direct tandem type color printer. The printer 1 includes a main casing 2 having a generally box shape. The main casing 2 has an upper portion provided with a top cover 6 which can be opened or closed for opening and closing an opening 5. The top cover 6 has a rear end portion pivotally movably supported to the main casing 2. The printer 1 includes four process cartridges 11 corresponding to colors different from each other.

Each process cartridge 11 is detachable and attachable relative to the main casing 2. When mounted, the process cartridges 11 are juxtaposedly arrayed in the frontward/rearward direction within the main casing 2. Each process cartridge 11 includes a drum cartridge 24 and a developing cartridge 25 detachable from and attachable to the drum cartridge 24.

Each drum cartridge 24 has a photosensitive drum 15. The photosensitive drum 15 is cylindrical in shape and extends in a lateral direction (rightward/leftward direction), and is rotatably supported to a frame of the drum cartridge 24.

The developing cartridge 25 has a developing roller 16 which has a developing roller shaft 30 extending in the lateral direction and made from metal. The developing roller 16 has a rear side exposed to an outside through a rear end portion of a frame of the developing cartridge 25. The developing roller 16 is positioned diagonally above and frontward of the photosensitive drum 15 and in contact therewith.

The developing cartridge 25 is provided with a supply roller 27, a layer thickness regulation blade 28, a toner chamber 46, and an agitator 47. The supply roller 27 is adapted to supply toner to the developing roller 16. The layer thickness regulation blade 28 is adapted to regulate a thickness of a toner layer supplied to the developing roller 16. The toner chamber 46 is positioned above the supply roller 27 and the layer thickness regulation blade 28, and the agitator 47 is provided in the toner chamber 46 for agitating the toner. The agitator 47 includes an agitation shaft 48 extending in the lateral direction and agitation blades 49 extending radially outwardly from the agitation shaft 48.

Toner accommodated in the toner chamber 46 is subjected to tribo-electric charging to have a positive polarity between the supply roller 27 and the developing roller 16. The toner is carried on an outer peripheral surface of the developing roller 16 in a form of a thin toner layer having a uniform thickness by the layer thickness regulation blade 28.

A scorotron charger 26 and an LED unit 12 are provided in confrontation with each photosensitive drum 15. After an outer peripheral surface of the photosensitive drum 15 is uniformly charged by the scorotron charger 26, the surface is exposed to light by the LED unit 12 based on a predetermined image data to form an electrostatic latent image on the surface. Then, a visible toner image (developing agent image) corresponding to the electrostatic latent image is formed on the outer peripheral surface of the photosensitive drum 15 by supplying toner carried on the developing roller 16 to the corresponding photosensitive drum 15.

A sheet cassette 7 is provided at a bottom portion of the main casing 2 for accommodating sheets S therein in a stacked state. Each sheet S accommodated in the sheet cassette 7 is passed through a U-shaped passage and is conveyed to a position between the photosensitive drum 15 and a conveyor belt 19 at a prescribed timing by a pickup roller 8, a sheet supply roller 9 and a pair of registration rollers 10. Then, each sheet S is conveyed rearward by the conveyer belt 19 at a position between each photosensitive drum 15 and each transfer roller 20. The toner image formed on the outer peripheral surface of each photosensitive drum 15 is sequentially transferred and superimposed onto the sheet S, thereby providing a color image on the sheet S.

The sheet S on which the color image has been formed is then conveyed to a fixing unit provided downstream of the conveyer belt 19. The fixing unit includes a heat roller 21 and a pressure roller 22. The color image is thermally fixed to the sheet S when the sheet S passes through the heat roller 21 and the pressure roller 22. The sheet S carrying the color image is then conveyed through an U-shaped passage frontward and upward, and is discharged onto a discharge tray 23 provided at the top cover 6.

2. Details of Developing Cartridge

Figure 2:
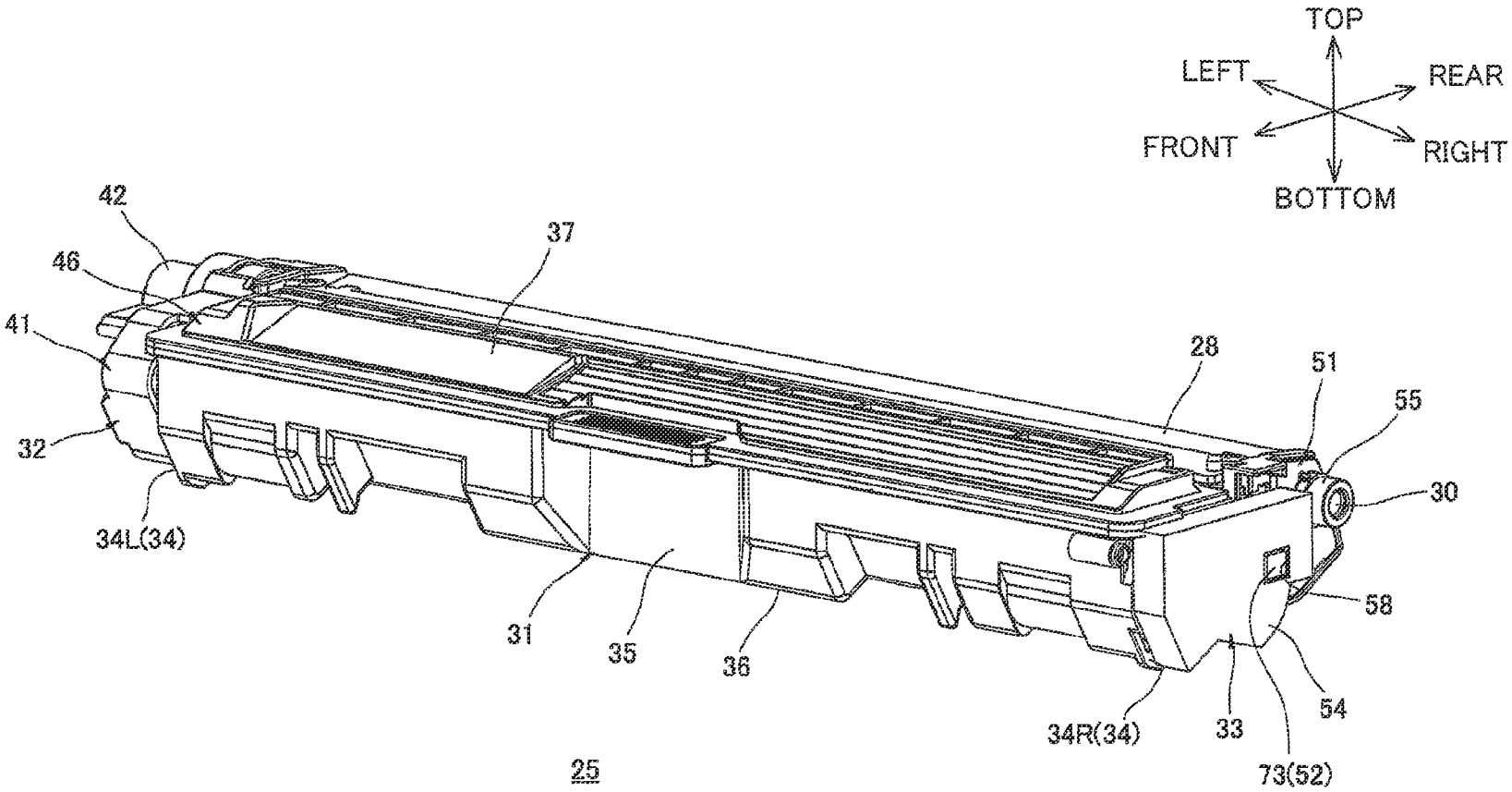
FIG. 2 is a perspective view of a developing cartridge accommodated in the printer shown in FIG. 1 as viewed from a diagonally front right side.
Figure 3:
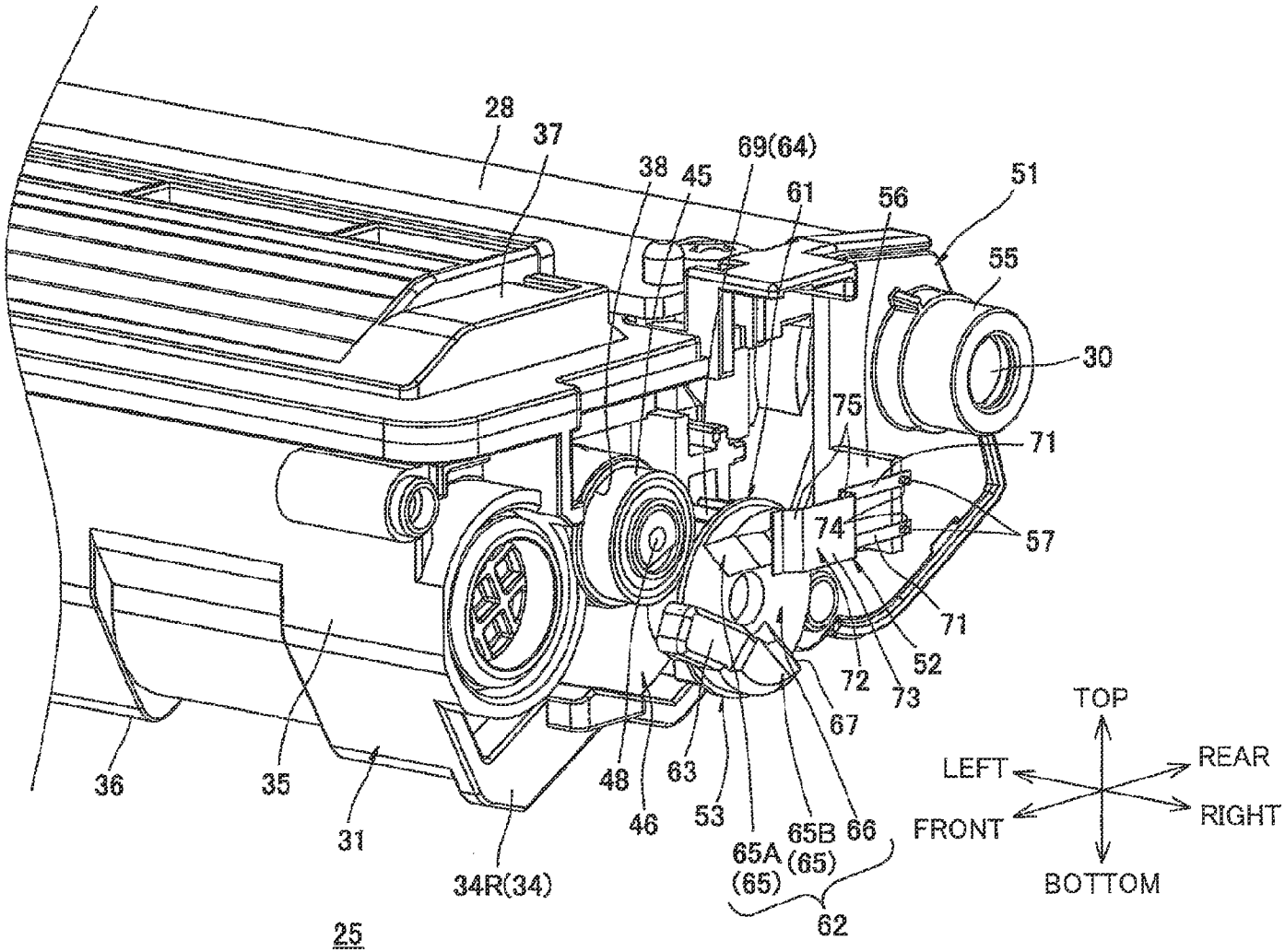
FIG. 3 is a partial perspective view of the developing cartridge of FIG. 2 as viewed from a diagonally front right side and without a power supply side cover.

As shown in FIGS. 2 and 3, the developing cartridge 25 includes a cartridge frame 31, a drive unit 32 positioned at left side of the cartridge frame 31, and a power supply unit 33 positioned at right side of the cartridge frame 31. The drive unit 32 may be positioned at a right side of the cartridge frame 31.

Throughout the description of the developing cartridge 25, regarding "direction", a side at which the developing roller 16 is positioned will be referred to as a "rear side" of the developing cartridge 25, and a side at which the thickness regulation blade 28 is positioned will be referred to as an "upper side" of the developing cartridge 25. That is, a "frontward/rearward direction" with respect to the developing cartridge 25 is different from the "frontward/rearward direction" with respect to the printer 1. More specifically, the developing cartridge 25 is assembled to the drum cartridge 24 and to the printer 1 such that the rear side and the front side of the developing cartridge 25 will correspond to a "lower rear side" and an "upper front side" of the printer 1.

(1) Cartridge Frame

The cartridge frame 31 extends in the lateral direction (confronting direction) and is generally box shaped. The cartridge frame 31 includes a pair of side walls 34, a front wall 35, a lower wall 36 and an upper wall 37. The pair of side walls 34 includes a left side wall 34L and a right side wall 34R.

Each side wall 34 extends in the frontward/rearward direction and in the vertical direction, and is generally rectangular shaped in a side view. The pair of side walls 34 is spaced away from each other in the lateral direction, and each side wall 34 is formed with an agitator shaft exposure hole 38 that exposes the agitation shaft 48 to the outside.

The exposure hole 38 is positioned at a generally center portion of the side wall 34 in the frontward/rearward direction and is generally circular shaped in a side view. The exposure hole 38 is penetrated through a thickness of the side wall 34 and has a diameter greater than an outer diameter of each lateral end portion of the agitation shaft 48. Each lateral end portion of the agitation shaft 48 extends through the exposure hole 38 and protrudes laterally outward from the side wall 34. An agitator gear 45 is fixedly (non-rotatably) coupled to each lateral end portion of the agitator shaft 48.

The front wall 35 extends in the lateral direction and is spanned between front end portions of the side walls 34. The lower wall 36 extends in the lateral direction and is spanned between lower end portions of the side walls 34 such that the lower wall 36 is connected to a lower end portion of the front wall 35. The upper wall 37 extends in the lateral direction and is spanned between upper end portions of the side walls 34 such that the upper wall 37 is connected to an upper end portion of the front wall 35. The upper wall 37 has a rear end portion at which the layer thickness regulation blade 28 is positioned such that the layer thickness regulation blade 28 is in contact with the developing roller 16 from above.

(2) Drive Unit

As shown in FIG. 2, the drive unit 32 includes a drive side cover 41 which extends in the lateral direction with its leftmost end being closed. The drive side cover 41 is hollow prismatic body shaped, and is provided with a collar portion 42. The collar portion 42 is positioned at a generally center portion of the drive side cover 41 in the frontward/rearward direction, and protrudes leftward therefrom. The collar portion 42 is generally hollow cylindrical shaped with its right end portion being in communication with an internal space of the drive side cover 41.

A generally cylindrical developing coupling (not shown) extending in the lateral direction is positioned within and supported to the collar portion 42 such that the developing coupling is rotatable relative to the collar portion 42. The developing coupling has a left end portion exposed to the outside from a left end portion of the collar portion 42. The left end portion of the developing coupling is fitted with a main coupling (not shown) provided to the main casing 2 such that relative rotation therebetween is prevented. A driving force from the main casing 2 is transmitted to the developing coupling through the main coupling. Further, the driving force is transmitted, through a gear train (not shown), to the developing roller shaft 30, a shaft of the supply roller 27, and the agitator shaft 48.

(3) Power Supply Unit

As shown in FIGS. 2 and 3, the power supply unit 33 includes a bearing member 51, a moving member 53, a cartridge electrode 52, and a power supply side cover 54.

(3-1) Bearing Member

The bearing member 51 is assembled to a right side of the right side wall 34R at the rear end portion of the developing cartridge 25. The bearing member 51 is made from an electrically conductive resin, and is generally rectangular plate shaped in a side view. The bearing member 51 includes a developing roller shaft support portion 55 and an electrode support portion 56.

The developing roller shaft support portion 55 is positioned at a rear end portion of the bearing member 51 and is generally hollow cylindrical shaped extending rightward from a right side surface of the bearing member 51. The developing roller shaft support portion 55 has an inner diameter approximately equal to or greater than an outer diameter of a right end portion of the developing roller shaft 30. Further, the bearing member 51 is formed with an opening (not shown) coaxial with the developing roller shaft support portion 55 and having a diameter equal to the inner diameter of the developing roller shaft support portion 55. The right end portion of the developing roller shaft 30 extends through and is rotatably supported to the developing roller shaft support portion 55.

The electrode support portion 56 is positioned at a front end portion of the bearing member 51. The electrode support portion 56 is generally flat plate shaped, protruding rightward from the right side surface of the bearing member 51 and extending in a vertical direction. The electrode support portion 56 has a right end portion provided with two support bosses 57 adapted to support the cartridge electrode 52.

The two support bosses 57 are in confrontation with and spaced away from each other in the vertical direction. Each support boss 57 is generally cylindrical shaped protruding rightward from the right side surface of the electrode support portion 56.

(3-2) Moving Member

Figure 4A:
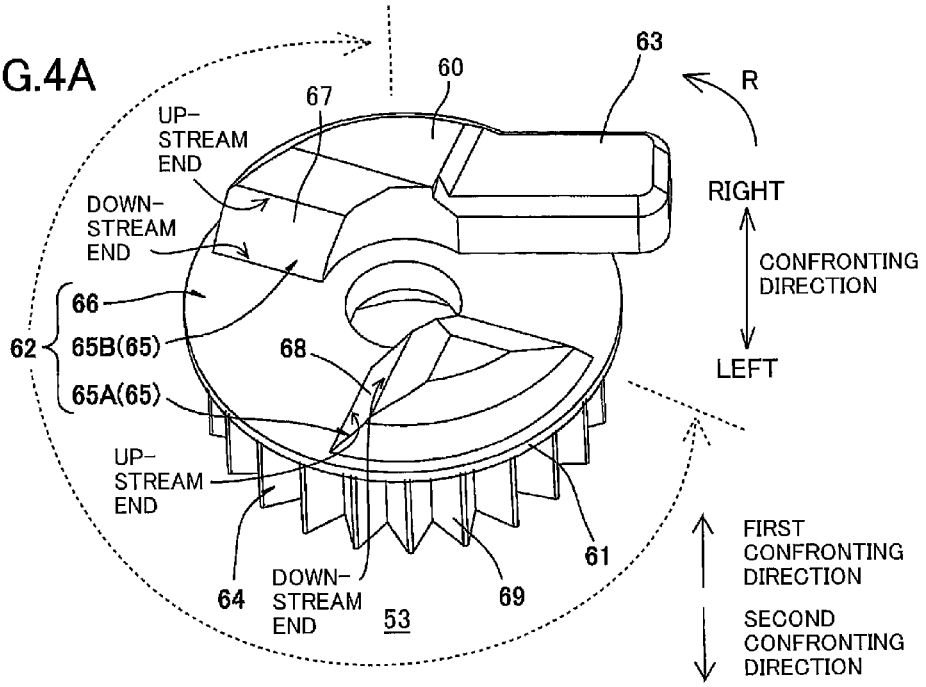
FIG. 4A is a perspective view of a moving member which is a component of the developing cartridge of FIG. 3 as viewed from a right side.
Figure 4B:
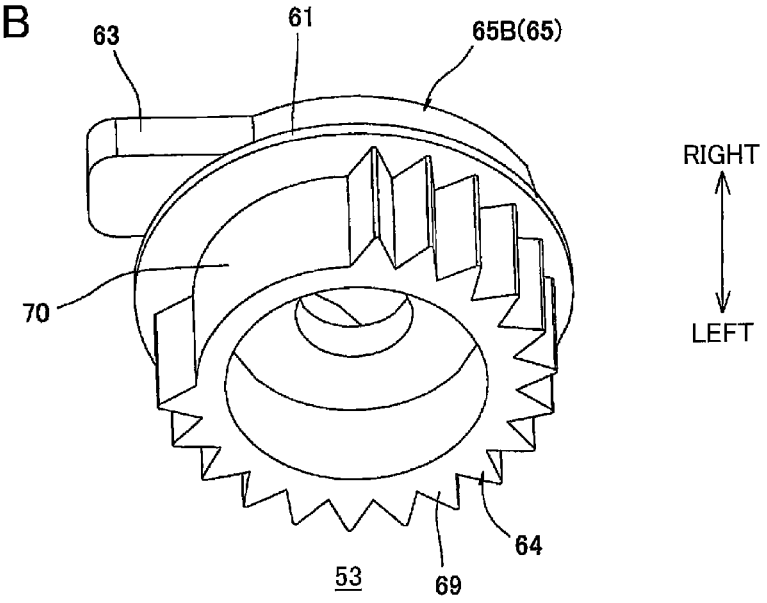
FIG. 4B is a perspective view of the moving member as viewed from a left side.

As shown in FIG. 3, the moving member 53 is positioned frontward of the bearing member 51. As shown in FIGS. 4A and 4B, the moving member 53 integrally includes a base portion 61, a displacement portion 62, a support portion 63, and a chipped gear 64 (gear teeth is partly lacking).

The base portion 61 has a thickness in the lateral direction and is generally circular disc shaped whose center portion is formed with a through-hole. The displacement portion 62 includes two projections 65 (65A, 65B) and a single recessed portion 66, those arrayed in a circumferential direction of the base portion 61 about a center axis thereof with a center angle of 270 degree, as indicated by a dotted line in FIG. 4A.

The two projections 65 are angularly spaced away from each other by 180 degrees. Each projection 65 protrudes rightward from a right side surface of the base portion 61 and is sector shaped in a side view whose center angle is 90 degrees. In the following description, assuming that the cartridge electrode 52 and the moving member 53 are in confrontation with each other in the lateral direction. One of the projections 65 positioned at a downstream side in a counterclockwise direction in a right side view will be referred to as a first projection 65A, and remaining one of the projections 65 positioned at an upstream side in the counterclockwise direction in a right side view will be referred to as a second projection 65B.

Further, as shown in FIG. 4A, a connecting portion 60 is provided at the moving member 53 at a position immediately upstream of the second projection 65B in the counterclockwise direction in a right side view. The connecting portion 60 is sector shaped protruding rightward from the right side surface of the base portion 61 and in flush with the second projection 65B.

The recessed portion 66 is positioned between the projections 65A and 65B, and has a sector shape whose center angle is 90 degrees defined by the right side surface of the base portion 61 and the projections 65A, 65B. That is, the recessed portion 66 is recessed leftward from the projections 65. More specifically, the recessed portion 66 is defined by a first end face 67 and a second end face 68. The first end face 67 is positioned upstream of the second end face 68 in the counterclockwise direction in a right side view. The first end face 67 is inclined diagonally rightward in a direction from the downstream end to the upstream end of the first end face 67, and the second end face 68 is inclined diagonally leftward in a direction from the downstream end to the upstream end of the second end face 68 in the counterclockwise direction in a right side view.

The cartridge electrode 52 may have configuration provided with the first end face (first inclined surface) and the second end face (second inclined surface).

The support portion 63 is generally rectangular shaped in a right side view extending from the connecting portion 60 toward an upstream side thereof in a tangential direction relative to a circumferential direction of the base portion 61, that is, in a direction of a tangential line to an upstream end portion of the displacement portion 62 in the counterclockwise direction in a right side view.

The chipped gear 64 is generally cylindrical shaped extending leftward from a left side surface of the base portion 61. The chipped gear 64 is concentric with the base portion 61. Gear teeth are provided at least at a position corresponding to the displacement portion 62 such that an array of the gear teeth along the circumferential direction of the base portion 61 has a center angle of 270 degrees. More specifically, a most upstream side tooth of the array of the gear teeth in the counterclockwise direction in a right side view is positioned below the most upstream side of the displacement portion 62, and a most downstream side tooth of the array of the gear teeth in the counterclockwise direction in a right side view is positioned below the most downstream side of the displacement portion 62. Incidentally, in the chipped gear 64, a portion where teeth are provided will be referred to as a toothed portion 69, and a portion where teeth are not provided will be referred to as a toothless portion 70.

The moving member 53 is supported to the right side wall 34R at a right side thereof and is rotatable about an axis of the base portion 61 in a counterclockwise direction, indicated as a rotation direction R in FIG. 4A. In a state where the developing cartridge 25 is a new cartridge (not in use), the chipped gear 64 is in meshing engagement with the agitator gear 45 from behind at the downstream end portion of the toothed portion 69 in the counterclockwise direction in a right side view. In this case, the first projection 65A is positioned at an upper end portion of the moving member 53.

(3-3) Cartridge Electrode

The cartridge electrode 52 is made from a material with high rigidity and electrical conductivity, such as metal. The cartridge electrode 52 is adapted to be electrically connected to a main electrode 81 (FIGS. 6A, 6B, described later) at a side of the main casing 2. The cartridge electrode 52 integrally includes a power supplied portion 72 and two supported portions 71.

The power supplied portion 72 is generally U-shaped in a plan view with its left end being open. More specifically, the power supplied portion 72 integrally includes a main portion 73 and two leg portions 75. The main portion 73 is generally rectangular shaped in a side view and extends in the frontward/rearward direction (orthogonal direction). The two leg portions 75 are bent (curved) leftward from front and rear end portions of the main portion 73, respectively. One of the leg portions 75 positioned at a front side will be referred to as a front leg portion 75 and remaining one of the leg portions 75 positioned at a rear side will be referred to as a rear leg portion 75. Incidentally, the main portion 73 has a generally center portion in the frontward/rearward direction where the main electrode 81 (described later) contacts when the developing cartridge 25 is mounted in the main casing 2. In other words, the generally center portion of the main portion 73 functions as a contact portion 76 (FIG. 6B) with the main electrode 81.

The two supported portions 71 are spaced away from each other in the vertical direction and connected to a rear end portion of the power supplied portion 72. Each supported portion 71 is generally beam shaped and extends rearward from a left end portion of the rear end portion of the power supplied portion 72 (more specifically, a left end portion of the rear leg portion 75). Each supported portion 71 has a vertical length smaller than that of the power supplied portion 72. For this reason, the supported portion 71 has rigidity smaller than that of the power supplied portion 72. Further, each supported portion 71 has a rear end portion formed with a fitting hole 74. The fitting hole 74 is penetrated through a thickness of the supported portion 71. Each support boss 57 of the bearing member 51 extends through the corresponding fitting hole 74.

The support bosses 57 are loosely fitted in the fitting holes 74, respectively, so that the cartridge electrode 52 is supported to the electrode support portion 56 of the bearing member 51. With this configuration, the cartridge electrode 52 is electrically connected to the bearing member 51, and also pivotally movable about the rear end portions of the supported portions 71 in the lateral direction between a first position (FIG. 6B) and a second position (FIG. 6A) pivotally moved leftward from the first position.

When the developing cartridge 25 is a new (unused) cartridge, the cartridge electrode 52 is at the first position where the front leg portion 75 of the power supplied portion 72 is in contact with the first projection 65A from a right side thereof (FIG. 3).

(3-4) Power Supply Side Cover

As shown in FIG. 2, the power supply side cover 54 is generally rectangular shaped in a side view, whose right end portion is closed. The power supply side cover 54 is adapted to cover the right end portion of the developing cartridge 25 so as to cover the cartridge electrode 52 and the moving member 53. The power supply side cover 54 is formed with an opening 58 for exposing the cartridge electrode 52 to the outside.

The opening 58 is positioned at a rear end portion of the power supply side cover 54, and has a generally rectangular shape in a side view. In a state where the developing cartridge 25 is a new cartridge, the cartridge electrode 52 is exposed to the outside through the opening 58 such that a right side surface of the main portion 73 is generally flush with a right side surface of the power supply side cover 54.

3. Main Casing

As shown in FIGS. 6A through 7B, the main electrode 81, an actuator 82, a photo-sensor 83 and a CPU 84 are provided within the main casing 2.

Figure 7A:
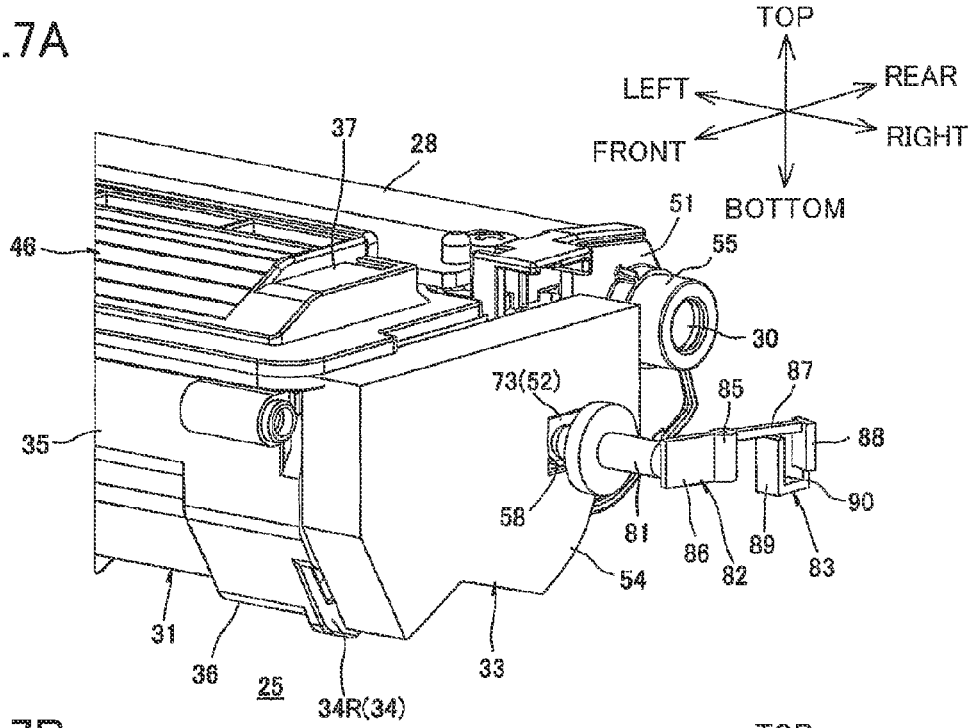
Figure 7B:
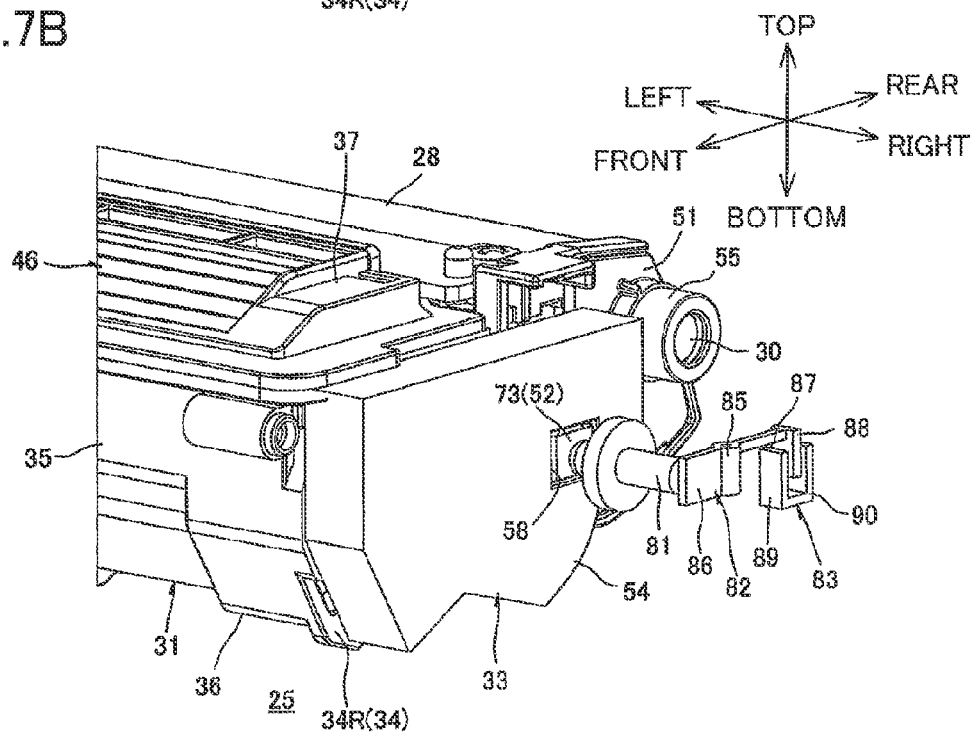

The main electrode 81 is positioned adjacent to the right side of the developing cartridge 25 when the developing cartridge 25 is mounted in the main casing 2. The main electrode 81 is made from metal. The main electrode 81 extends in the lateral direction and is generally cylindrical shaped. The main electrode 81 is supported to the main casing 2 and is slidably movable in the lateral direction between an advanced position as shown in FIG. 7A and a retracted position as shown in FIG. 7B. The advanced position is advanced leftward, and the retracted position is moved rightward from the advanced position. The main electrode 81 is electrically connected to a power source (not shown) in the main casing 2.

The actuator 82 integrally includes a pivot shaft 85, an abutment lever 86 and a light shielding lever 87. The pivot shaft 85 extends in the vertical direction and is generally hollow cylindrical shaped. The abutment lever 86 extends frontward from the pivot shaft 85. The light shielding lever 87 extends rearward from the pivot shaft 85. The light shielding lever 87 has a rear end portion provided with a light shielding plate 88 extending downward therefrom.

The actuator 82 is pivotally movably supported to the main casing 2 at a position adjacent to the right side of the developing cartridge 25 such that the abutment lever 86 is pivotally movable about the pivot shaft 85 so that the abutment lever 86 can be contacted with the right end of the main electrode 81.

Figure 6A:
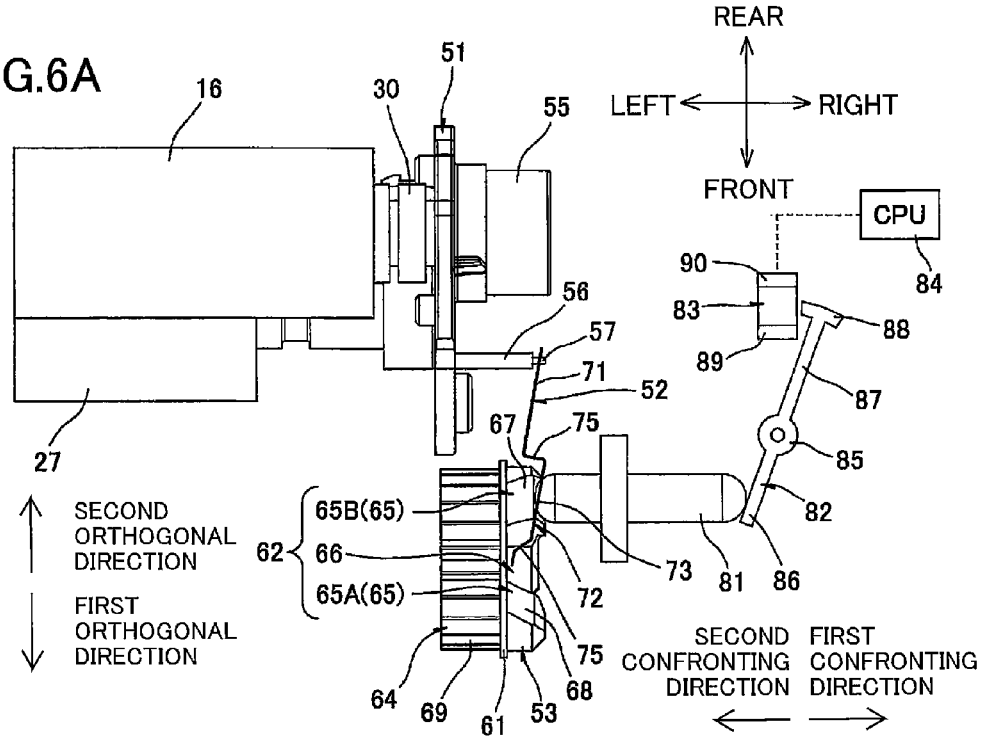
Figure 6B:
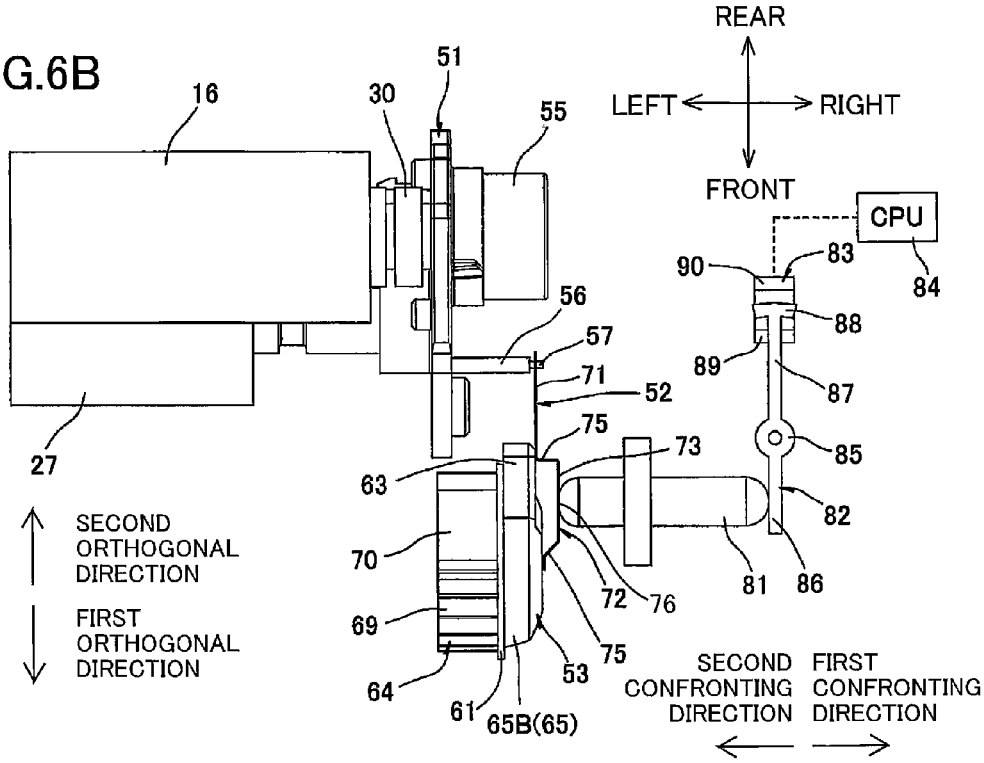

More specifically, the actuator 82 is pivotally movable to a light transmitting position as shown in FIG. 6A and to a light shielding position as shown in FIG. 6B. In the light transmitting position, the abutment lever 86 is directed diagonally frontward and leftward and the light shielding lever 87 is directed diagonally rightward and rearward. In the light shielding position, the abutment lever 86 and the light shielding lever 87 are directed in the frontward/rearward direction. The actuator 82 is connected to an urging member (not shown) such as a spring so that the actuator 82 is normally urged to the light transmitting position (so that the actuator 82 is urged clockwise in a plan view).

The photo-sensor 83 includes a light emitting element 89 and a light receiving element 90. The light emitting element 89 is adapted to emit detection light. The light receiving element 90 is adapted to receive the detection light and positioned spaced away from and rearward of the light emitting element 89. The photo-sensor 83 is positioned at the rear side of the actuator 82 such that the light shielding plate 88 of the actuator 82 in the light shielding position is positioned between the light emitting element 89 and the light receiving element 90. A combination of the photo-sensor 83 and the actuator 82 constitutes a detection unit.

In the light shielding position of the actuator 82 (FIG. 6B), the light shielding plate 88 is positioned between the light emitting element 89 and the light receiving element 90, so that the detection light emitted from the light emitting element 89 is blocked by the light shielding plate 88. On the other hand, in the light transmitting position of the actuator 82 (FIG. 6A), the light shielding plate 88 is retracted rightward away from a gap between the light emitting element 89 and the light receiving element 90. Thus, the detection light emitted from the light emitting element 89 is received by the light receiving element 90, whereupon an ON signal is transmitted from the photo-sensor 83. The CPU 84 is provided in the main casing 2 and is electrically connected to the photo-sensor 83 so as to receive an ON signal from the photo-sensor 83.

4. Operation for Detecting New Developing Cartridge

An operation for detecting a new developing cartridge 25 will be described. When the process cartridge 11 (the developing cartridge 25) is not assembled to the main casing 2, the actuator 82 is at the light transmitting position by the urging force of the urging member (not shown). Thus, the main electrode 81 is at the advanced position. In this case, the photo-sensor 83 transmits an ON signal to the CPU 84.

Upon receipt of the ON signal from the photo-sensor 83, the CPU 84 determines that the main electrode 81 is at the advanced position. Then, if this state continues for a predetermined time period (if the advanced position of the main electrode 81 is maintained for the predetermined time period), in other words, if the ON signal from the photo-sensor 83 is not interrupted within the predetermined time period, the CPU 84 determines that the developing cartridge 25 is not assembled to the main casing 2.

Then, the top cover 6 of the main casing 2 is opened to insert, from above into the main casing 2, the process cartridge 11 to which a new developing cartridge 25 is assembled. The main portion 73 of the cartridge electrode 52 is brought into contact with the left end portion of the main electrode 81.

Then, the main electrode 81 is pushed rightward from the advanced position to the retracted position against the urging force of the urging member (not shown) applied to the actuator 82, so that the actuator 82 is pivotally moved in the counterclockwise direction in a plan view from the light transmitting position to the light shielding position.

Thus, output of the ON signal from the photo-sensor 83 to the CPU 84 is interrupted. That is, a detection unit (the actuator 82 and the photo-sensor 83) detects the first position of the cartridge electrode 52 and the retracted position of the main electrode 81.

Then, the CPU 84 determines that the main electrode 81 has been moved from the advanced position to the retracted position due to interruption of the ON signal from the photo-sensor 83.

After assembly of the developing cartridge 25 into the main casing 2, the main coupling (not shown) in the main casing 2 is fitted with the developing coupling (not shown) of the developing unit 32, preventing relative rotation therebetween. Thus, a driving force from the main casing 2 is transmitted to the developing coupling through the main coupling for starting a warm-up operation.

Then, a driving force from the developing coupling (not shown) is transmitted to the agitator shaft 48 through the gear train (not shown) to rotate the agitator 47. As a result of rotation of the agitator 47, as shown in FIG. 3, a driving force from the agitator shaft 48 is transmitted to the toothed portion 69 of the chipped gear 64 of the moving member 53 through the agitator gear 45, so that the moving member 53 is rotated in the counterclockwise direction in a right side view.

Figure 5A:
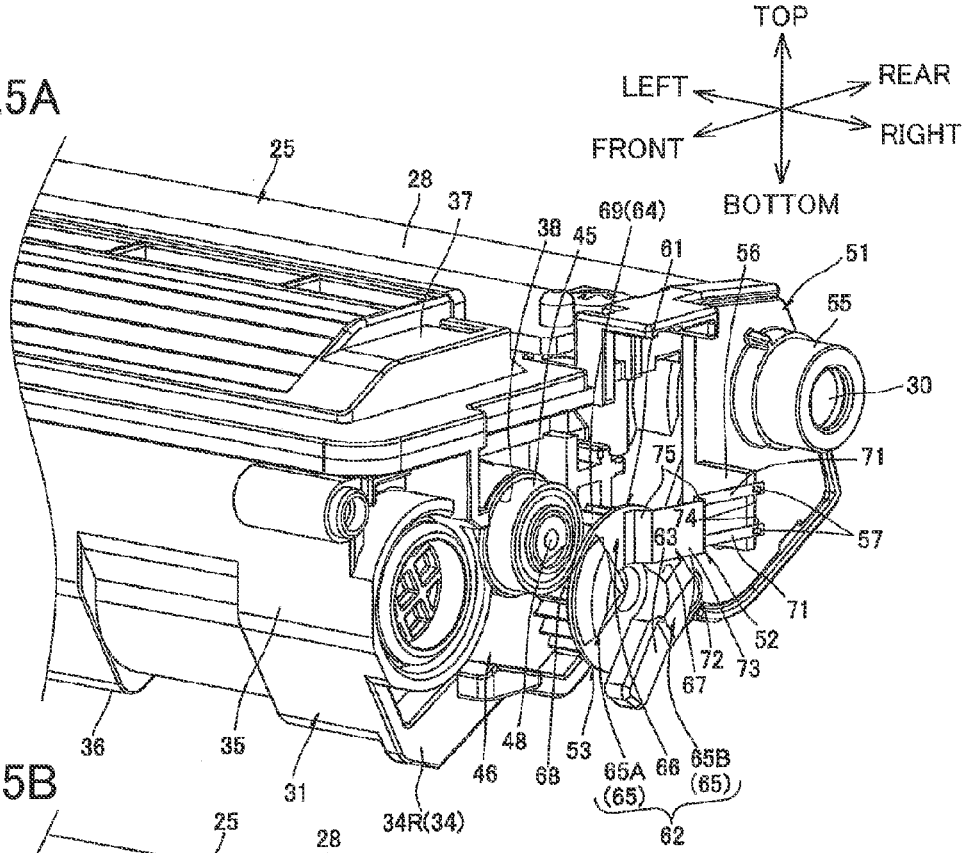

Accordingly, as shown in FIG. 5A, the cartridge electrode 52 is moved relative to the moving member 53 in the clockwise direction in a right side view such that the front leg portion 75 of the cartridge electrode 52 which has been seated on the first projection 65A confronts the recessed portion 66. In other words, the cartridge electrode 52 can be moved leftward by a distance corresponding to a depth of the recessed portion 66.

More specifically, the cartridge electrode 52 is pushed leftward by the urging force of the urging member (not shown) applied to the actuator 82 through the main electrode 81, so that the cartridge electrode 52 is pivotally moved leftward about the rear end portions of the supported portions 71 from the first position to the second position while the front leg portion 75 of the cartridge electrode 52 is moved along the inclined surface of the second end face 68. As a result, as shown in FIGS. 6A and 7A, the main portion 73 of the cartridge electrode 52 is retracted leftward from the right side surface of the power supply side cover 54.

Simultaneously, the main electrode 81 is pushed leftward from the retraced position to the advanced position by the urging force of the urging member (not shown) applied to the actuator 82, so that the actuator 82 is pivotally moved in the clockwise direction in a plan view by the urging force of the urging member (not shown) to be moved to the light transmitting position from the light shielding position.

Thus, the photo-sensor 83 outputs an ON signal to the CPU 84. That is, the detection unit (the actuator 82 and the photo-sensor 83) detects the second position of the cartridge electrode 52 and the advanced position of the main electrode 81.

Then, the CPU 84 determines that the main electrode 81 has been moved from the retracted position to the advanced position upon receipt of the ON signal from the photo-sensor 83.

As a result of further rotation of the moving member 53 in the counterclockwise direction in a right side view, the cartridge electrode 52 is relatively moved in the clockwise direction in a right side view from the recessed portion 66.

Then, the front leg portion 75 of the cartridge electrode 52 is moved along the inclined surface of the first end face 67 toward the second projection 65B, so that the cartridge electrode 52 which has been seated on the recessed portion 66 is seated on the second projection 65B so as to push the main electrode 81 rightward against the urging force of the urging member (not shown) applied to the actuator 82.

As a result, the cartridge electrode 52 is pivotally moved rightward about the rear end portions of the supported portions 71 from the second position to the first position against the urging force of the urging member (not shown) applied to the actuator 82.

At this time, as shown in FIGS. 6B and 7B, the main portion 73 of the cartridge electrode 52 is advanced rightward so that the right side surface of main portion 73 of the cartridge electrode 52 is flush with the right side surface of the power supply side cover 54.

Simultaneously, the main electrode 81 is pushed rightward from the advanced position to the retracted position against the urging force of the urging member (not shown), so that the actuator 82 is pivotally moved in the counterclockwise direction in a plan view to be moved from the light transmitting position to the light shielding position.

Thus, output of the ON signal from the photo-sensor 83 to the CPU 84 is interrupted. That is, the detection unit (the actuator 82 and the photo-sensor 83) detects the first position of the cartridge electrode 52 and the retracted position of the main electrode 81. Due to the interruption of the ON signal from the photo-sensor 83, the CPU 84 determines that the main electrode 81 has been moved from the advanced position to the retracted position.

Figure 5B:
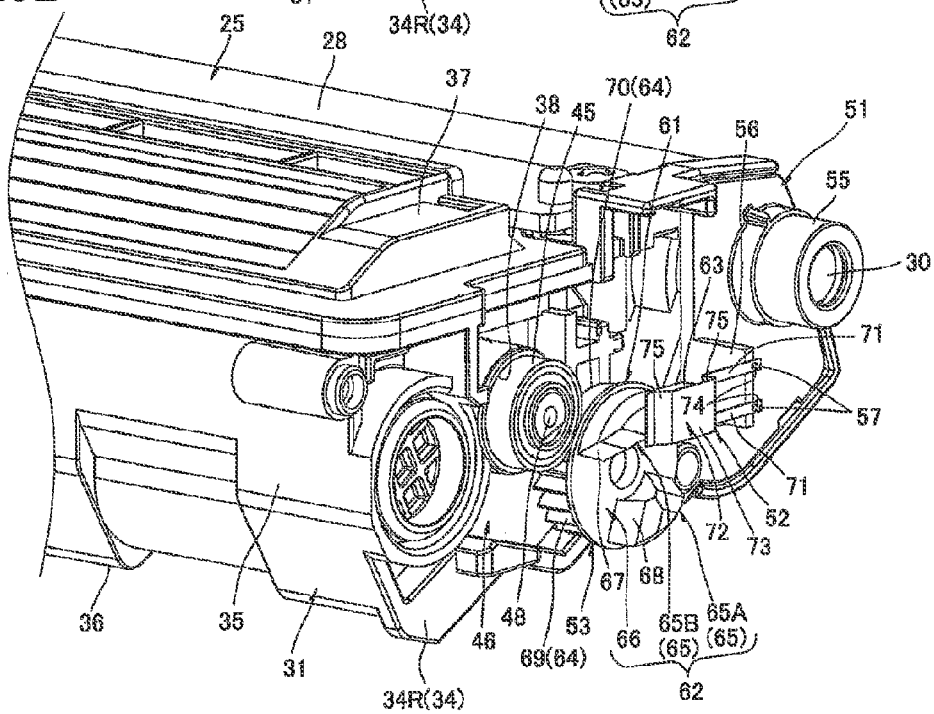

In accordance with further rotation of the moving member 53 in the counterclockwise direction in a right side view, as shown in FIG. 5B, the toothless portion 70 of the chipped gear 64 of the moving member 53 is brought into confrontation with the agitator gear 45, releasing meshing engagement between the toothed portion 69 of the chipped gear 64 and the agitator gear 45. Thus, rotation of the moving member 53 is stopped to terminate the warm-up operation.

At this time, as shown in FIG. 6B, the front leg portion 75 of the cartridge electrode 52 is supported to a rear end portion of the second projection 65B in a state where rotation of the moving member 53 is stopped while the rear leg portion 75 of the cartridge electrode 52 is supported to a rear end portion of the support portion 63 in a state where rotation of the moving member 53 is stopped. Thus, the first position of the cartridge electrode 52 can be maintained. That is, in a state where rotation of the moving member 53 is stopped, a portion defined from the rear end portion of the second projection 65B to the rear portion of the support portion 63 functions as a maintaining portion.

Further, the left end portion of the main electrode 81 is in contact with the contact portion 76 of the cartridge electrode 52. Further, upon supply of developing bias from the power source in the main casing 2 to the cartridge electrode 52 through the main electrode 81, the developing bias is supplied to the developing roller shaft 30 through the bearing member 51.

The CPU 84 determines that the developing cartridge 25 is a new (unused) cartridge based on the detection of movement of the main electrode 81 from the retracted position to the advanced position and then from the advanced position to the retracted position after starting the warm-up operation.

After the determination, the CPU 84 counts printing times, and notifies and displays on an operation panel (not shown) an exchanging timing of the developing cartridge 25 when the counted printing times approaches a predetermined printing times (for example, 6000 sheets printing).

Incidentally, the CPU 84 determines assembly of the developing cartridge 25 into the main casing 2 when the ON signal from the photo-sensor 83 is interrupted within a predetermined time period (that is, when the main electrode 81 is judged to be at the retracted position).

On the other hand, there is a case where after the new developing cartridge 25 is assembled, the developing cartridge 25 is again assembled to the main casing 2 after the developing cartridge 25 is detached from the main casing 2, for example, for removing a jammed sheet S. In such a case, rotation of the moving member 53 is stopped while the toothless portion 70 of the chipped gear 64 confronts the agitator gear 45.

Therefore, in the re-assembly, rotation of the moving member 53 is not started even after starting the warm-up operation, and as a result, the new cartridge detection will not be carried out. In the latter case, because the cartridge electrode 52 stays at the first position, the CPU 84 does not receive an ON signal from the photo-sensor 83. Thus, the CPU 84 determines that the main electrode 81 is at the retracted position.

Accordingly, the CPU 84 determines that the developing cartridge 25 has been assembled into the main casing 2. Further, the CPU 84 determines that the re-assembled cartridge 25 is an old cartridge 25. Then, the CPU 84 continues comparison between the predetermined printing times and the accumulated total number of printing times from the timing at which the CPU 84 determines that the assembled developing cartridge 25 is a new cartridge.

5. Operations and Effects (1) According to the above-described printer 1, movement of the cartridge electrode 52 to the first position (FIG. 7B) permits the main electrode 81 electrically connected thereto to be moved to the retracted position (FIG. 7B), and movement of the cartridge electrode 52 to the second position (FIG. 7A) permits the main electrode 81 to be moved to the advanced position (FIG. 7A). Conditions of the developing cartridge 25 (whether or not the developing cartridge 25 is a new cartridge) can be determined based on the movement of the main electrode 81. That is, the cartridge electrode 52 can be used for detecting whether or not the developing cartridge 25 is a new cartridge.

Accordingly, both power supply to the developing cartridge 25 and detection of the conditions of the developing cartridge 25 can be performed as long as positioning accuracy between the cartridge electrode 52 and the main electrode 81 is stabilized. Thus, accurate detection with respect to the conditions of the developing cartridge 25 can be performed.

(2) Further, the moving member 53 has the projections 65 and the recessed portion 66 recessed leftward from the projections 65 as shown in FIG. 4A. Therefore, movement of the cartridge electrode 52 in the lateral direction can be performed with a simple construction.

Further, the cartridge electrode 52 is seated on the projection 65 of the moving member 53, thereby positioning the cartridge electrode 52 at the first position, as shown in FIGS. 6A and 7A. Further, the cartridge electrode 52 confronts the recessed portion 66 of the moving member 53, thereby positioning the cartridge electrode 52 at the second position, as shown in FIGS. 6B and 7B. Accordingly, the cartridge electrode 52 can be moved from the first position to the second position so as to be retracted leftward.

(3) Further, as shown in FIG. 5A, the cartridge electrode 52 can be pivotally moved leftward from the first position to the second position while the cartridge electrode 52 is moved along the second end face 68 of the recessed portion 66. Further, as shown in FIG. 5B, the cartridge electrode 52 can be pivotally moved rightward from the second position to the first position while the cartridge electrode 52 is moved along the first end face 67 of the recessed portion 66. Therefore, the cartridge electrode 52 can be smoothly moved in the lateral direction.

(4) Further, as shown in FIG. 4B, the moving member 53 has the chipped gear 64 provided with the toothed portion 69 and the toothless portion 70. Therefore, stabilized angular rotational movement of the cartridge electrode 52 can be provided.

(5) Further, as shown in FIGS. 5A and 5B, the moving member 53 is rotatable in the counterclockwise direction in a right side view. Therefore, the cartridge electrode 52 can be moved stably with the simple construction.

(6) Further, as shown in FIG. 6B, when rotation of the moving member 53 is stopped, the support portion 63 of the moving member 53 can support the cartridge electrode 52 while the first position of the cartridge electrode 52 is maintained. Accordingly, after stopping rotation of the moving member, the cartridge electrode 52 can be stably contacted with the main electrode 81. Further, contact pressure from the main electrode 81 can be applied to both front and rear sides of the contact portion 76 where the cartridge electrode 52 is contacted with the main electrode 81 (that is, the generally center portion of the main portion 73 in the frontward/rearward direction).

(7) Further, contact pressure from the main electrode 81 can be stably applied to the power supplied portion 72 having a rigidity higher than that of the supported portion 71, as shown in FIGS. 5B and 6B.

(8) Further, the cartridge electrode 52 is at the first position prior to starting rotation of the moving member 53, as shown in FIGS. 2 and 3, and moved to the second position leftward of the first position in accordance with rotation of the moving member 53, as shown in FIGS. 5A and 7A. On the other hand, the main electrode 81 is at the retracted position when the cartridge electrode 52 is at the first position, as shown in FIG. 6B, and at the advanced position when the cartridge electrode 52 is at the second position, as shown in FIG. 6A. Further, the main electrode 81 is normally at the advanced position by the urging member (not shown). Accordingly, assembly or non-assembly of the developing cartridge 25 to the main casing 2 can be determined in accordance with movement of the main electrode 81 from the advanced position to the retracted position when the developing cartridge 25 is assembled to the main casing 2.

Further, in association with movement of the moving member 53, the main electrode 81 is moved from the retracted position to the advanced position, and then from the advanced position to the retracted position. Thus, conditions (new or used) of the developing cartridge 25 can be determined.

As a result, both detection of assembly or non-assembly of the developing cartridge 25 to the main casing 2 and detection of conditions of the developing cartridge 25 can be performed in accordance with movement of the main electrode 81 between the advanced position and the retracted position.

(9) Further, with a simple construction, existence or non-existence of the developing cartridge 25 in the main casing 2 can be detected by detecting the position of the main electrode 81.

(10) Further, according to the developing cartridge 25, the cartridge electrode 52 can be moved between the first position (FIG. 7A) and the second position (FIG. 7B).

Movement of the cartridge electrode 52 is detected by external components such as the main electrode 81, the actuator 82 and the photo-sensor 83. That is, the component of the developing cartridge 25, i.e., the cartridge electrode 52, can be used for detecting a new cartridge or an old cartridge. Accordingly, no additional component is required for the detection, which simplifies construction of the developing cartridge 25.

6. Second Embodiment

A developing cartridge 125 according to a second embodiment of the present invention will next be described with reference to FIGS. 8A and 8B wherein like parts and components are designated by the same reference numerals as those shown in the first embodiment (FIGS. 1 through 7B) to avoid duplicating description.

According to the first embodiment, the moving member 53 is in the form of generally disc shape, and is rotatable in the counterclockwise direction in a right side view. In contrast, according to the second embodiment, a moving member 96 is generally flat rectangular plate shaped, and is slidably and linearly movable in the frontward/rearward direction.

Further, according to the first embodiment, the CPU 84 determines that the assembled developing cartridge 25 is a new (unused) cartridge as a result of judgment that the main electrode 81 is moved from the retracted position to the advanced position, and then moved from the advanced position to the retracted position after starting the warm-up operation of the developing cartridge 25.

On the other hand, according to the second embodiment, the CPU 84 determines that the assembled developing cartridge 125 is a new (unused) cartridge as a result of judgment that the main electrode 81 is moved from the advanced position to the retracted position after starting the warm-up operation of the developing cartridge 125.

More specifically, a power supply unit 133 includes the moving member 96, a support rail 97, and a pinion gear 98. The support rail 97 is adapted to slidably support the moving member 96 in the frontward/rearward direction. The pinion gear 98 is adapted to input a driving force to the moving member 96.

The moving member 96 is generally U-shaped in a side view with its front end being open, and includes a displacement portion 99, and a rack portion 100. The displacement portion 99 is generally rectangular plate shaped in a side view, and has a front end portion formed into a slant surface where the surface is directed diagonally rightward and rearward.

The rack portion 100 is generally beam shaped extending frontward from a front lower end portion of the displacement portion 99. A front half portion of the rack portion 100 is provided with a toothed portion 91 at its upper surface, and a rear half portion of the rack portion 100 is a toothless portion 92.

The support rail 97 includes a pair of rail portions 95 confronting with each other and spaced away from each other in the vertical direction for slidably supporting upper and lower end portions of the moving member 96 such that an upper rail portion 95 is positioned above the upper end portion of the moving member 96 and a lower rail portion 95 is positioned below the lower end portion of the moving member 96.

The pinion gear 98 is fixed to the right end portion of the agitator shaft 48 at a position between the rail portions 95, 95, and is meshingly engageable with the front end portion of the toothed portion 91 of the rack portion 100 from above.

When the process cartridge 11 (the developing cartridge 125) is not assembled to the main casing 2, similar to the first embodiment, the actuator 82 is positioned at the light transmitting position by the urging force of the urging member (not shown), so that the main electrode 81 is positioned at the advanced position. Thus, the photo-sensor 83 outputs an ON signal to the CPU 84.

Then, if this state continues for a predetermined time period (if the advanced position of the main electrode 81 is maintained for the predetermined time period), in other words, if the ON signal from the photo-sensor 83 is not interrupted within the predetermined time period, the CPU 84 determines that the developing cartridge 125 is not assembled to the main casing 2.

When a new developing cartridge 125 (being not in use) is assembled into the main casing 2, the main coupling (not shown) in the main casing 2 is fitted with the developing coupling (not shown) of the drive unit 32, preventing relative rotation therebetween, to start the warm-up operation.

Figure 8A:
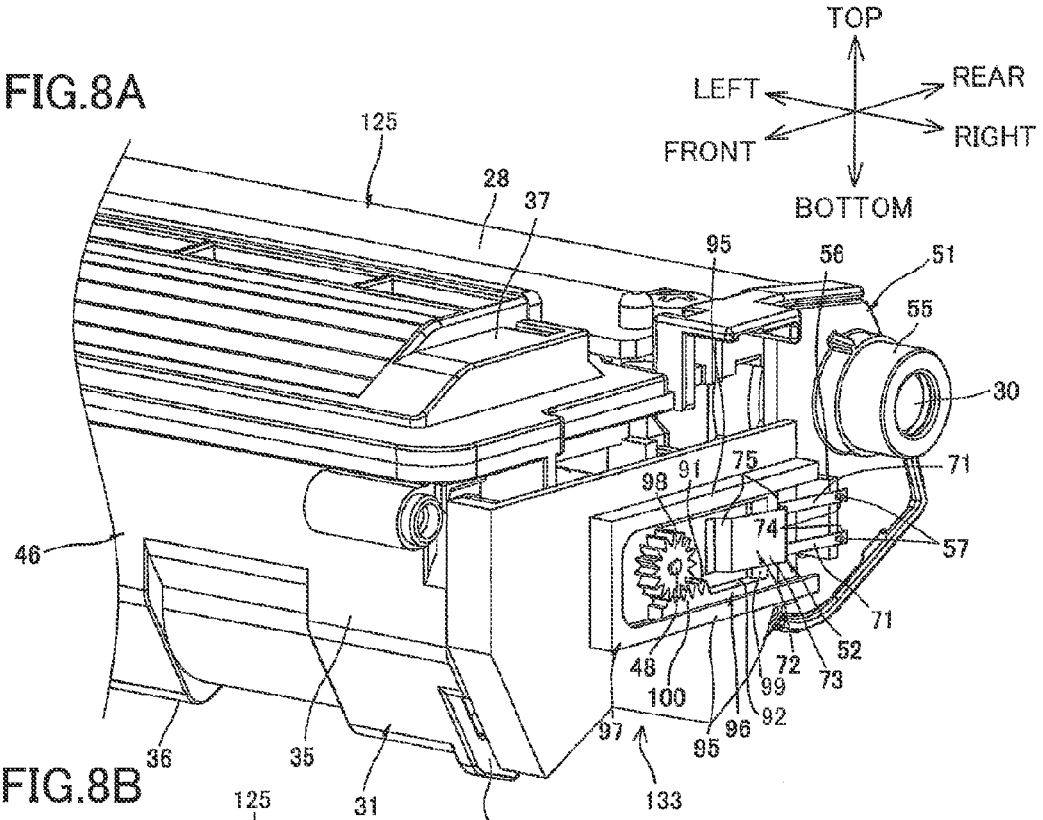
Figure 8B:
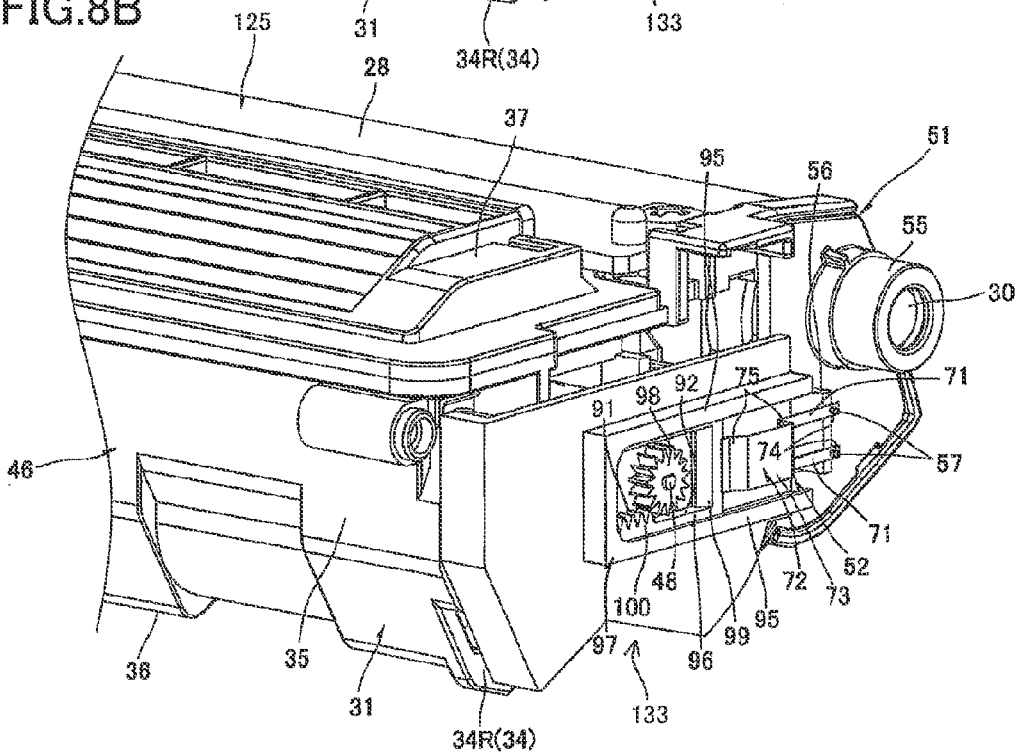

Incidentally, when the new developing cartridge 125 is assembled into the main casing 2, the cartridge electrode 52 is positioned at the second position (FIG. 8A).

After starting the warm-up operation, a driving force from the developing coupling (not shown) is transmitted to the agitator shaft 48 through the gear train (not shown) to rotate the agitator 47.

Upon rotation of the agitator 47, a driving force from the agitator shaft 48 is transmitted to the rack portion 100 of the moving member 96 through the pinion gear 98, so that the moving member 96 is linearly slidingly moved frontward.

As a result, the front leg portion 75 of the cartridge electrode 52 is seated on the right side surface of the displacement portion 99 after moving along the slant surface of the displacement portion 99 at its front end portion, so that the main electrode 81 is pushed rightward against the urging force of the urging member (not shown) applied to the actuator 82. When the toothed portion 92 of the rack portion 100 is brought into confrontation with the pinion gear 98, meshing engagement between the rack portion 100 and the pinion gear 98 is released to stop sliding movement of the moving member 96. Thus, the warm-up operation is terminated.

Consequently, the cartridge electrode 52 is pivotally moved rightward about the rear end portions of the supported portions 71 from the second position to the first position against the urging force of the urging member (not shown) applied to the actuator 82.

Simultaneously, the main electrode 81 is moved rightward from the advanced position to the retracted position against the urging force of the urging member (not shown) applied to the actuator 82, so that the actuator 82 is pivotally moved in the counterclockwise direction in a plan view from the light transmitting position to the light shielding position against the urging force of the urging member (not shown).

Thus, output of the ON signal from the photo-sensor 83 to the CPU 84 is interrupted. In other words, the detection unit (the actuator 82 and the photo-sensor 83) detects the first position of the cartridge electrode 52 and the retracted position of the main electrode 81. Then, the CPU 84 determines that the main electrode 81 has been moved from the advanced position to the retracted position due to interruption of the ON signal from the photo-sensor 83.

The CPU 84 determines that the developing cartridge 125 is a new (unused) cartridge based on the detection of movement of the main electrode 81 from the advanced position to the retracted position after starting the warm-up operation.

Incidentally, the CPU 84 determines assembly of the developing cartridge 125 into the main casing 2 when the ON signal form the photo-sensor 83 is interrupted within a predetermined time period (that is, when the main electrode 81 is judged to be at the retracted position).

According to the second embodiment, as shown in FIG. 8A, the moving member 96 is linearly slidingly movable frontward. Simple linear sliding movement of the moving member 96 can permit the cartridge electrode 52 to be moved. In other words, movement of the cartridge electrode 52 can be realized with a simple construction.

Further, according to the second embodiment, prior to sliding movement of the moving member 96, the cartridge electrode 52 is positioned at the second position pivotally moved leftward from the first position.

Accordingly, prior to the sliding movement of the moving member 96, damage to the cartridge electrode 52 due to interference from a right side of surrounding components can be restrained.

Further, according to the second embodiment, operations and effects similar to those of the first embodiment can also be obtained.

7. Third Embodiment

A developing cartridge 225 according to a third embodiment of the present invention will next be described with reference to FIGS. 9A through 10C wherein like parts and components are designated by the same reference numerals as those shown in the first embodiment (FIGS. 1 through 7B) to avoid duplicating description.

According to the first embodiment, the moving member 53 has two projections 65, and the single recessed portion 66 is defined between the two projections 65. Further, the cartridge electrode 52 is pivotally movable in the lateral direction between the first position shown in FIG. 6B and the second position shown in FIG. 6A where the cartridge electrode 52 is moved leftward from the first position. Further, the main electrode 81 is slidably movable in the lateral direction between the advanced position shown in FIG. 7A where the main electrode 81 is advanced leftward and the retracted position shown in FIG. 7B where the main electrode 81 is retracted rightward. Further, the actuator 82 is pivotally movable between the light transmitting position shown in FIG. 7A where the abutment lever 86 extends diagonally frontward and leftward and the light shielding lever 87 extends diagonally rearward and rightward and the light shielding position shown in FIG. 7B where the abutment lever 86 and the light shielding lever 87 are directed in the frontward/rearward direction. Further, the CPU 84 determines that the developing cartridge 25 is a new cartridge as a result of determination that the main electrode 81 is moved from the retracted position to the advanced position and then moved from the advanced position to the retracted position after starting the warm-up operation of the developing cartridge 25.

Figure 9A:
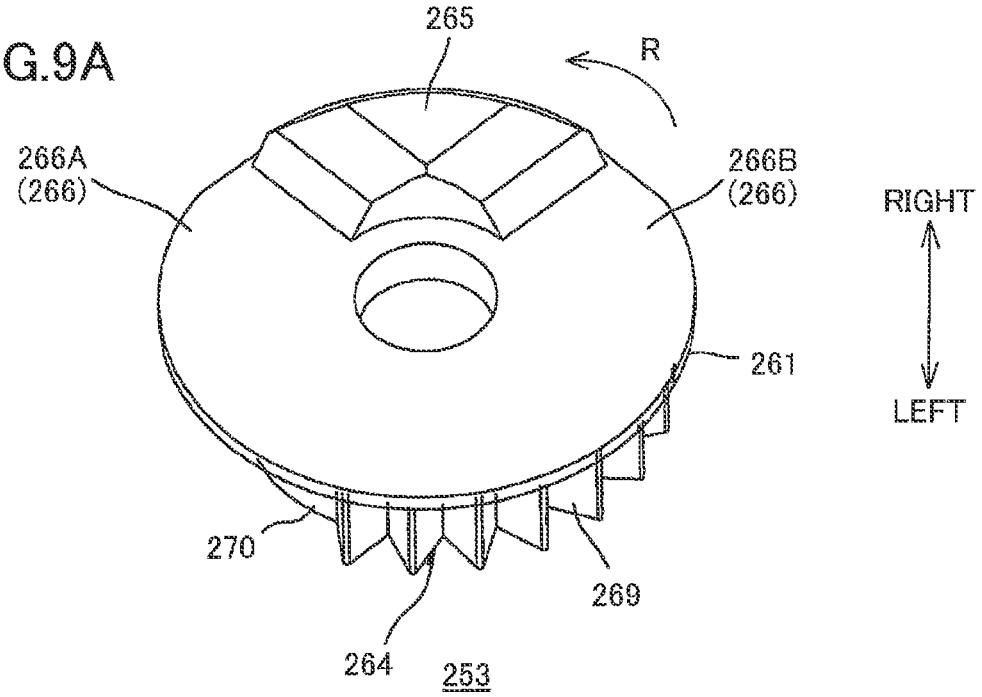
Figure 9B:
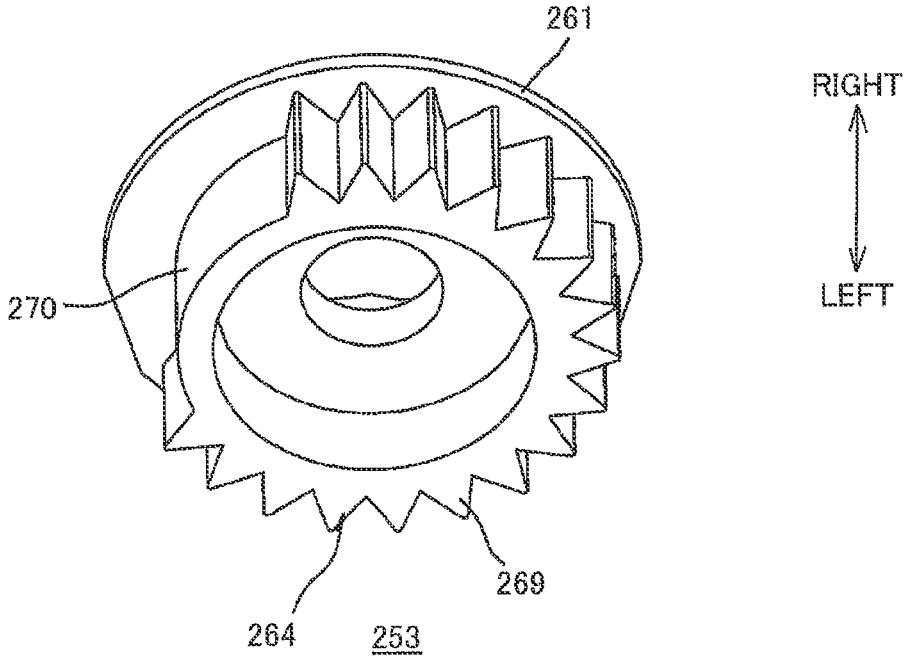

In contrast, according to the third embodiment, as shown in FIG. 9A, a moving member 253 has a single projection 265. A recessed portion 266 is positioned beside a downstream side and an upstream side of the projection 265 in the counterclockwise direction in a right side view. The recessed portion 266 positioned at the downstream side of the projection 265 in the counterclockwise direction in a right side view will be referred to as a first recessed region 266A, and the recessed portion 266 positioned at the upstream side of the projection 265 in the counterclockwise direction in a right side view will be referred to as a second recessed region 266B. Further, the moving member 253 includes a chipped gear 264 provided with a toothed portion 269 and a toothless portion 270, as shown in FIG. 9B. The toothed portion 269 has a center angle of 270 degrees. The toothless portion 270 is defined other than the toothed portion 269 and positioned below a portion of the first recessed region 266A.

Further, the cartridge electrode 52 is pivotally movable in the lateral direction between a first position (FIG. 10B) and a second position (FIG. 10C) pivotally moved rightward from the first position.

Figure 10A:
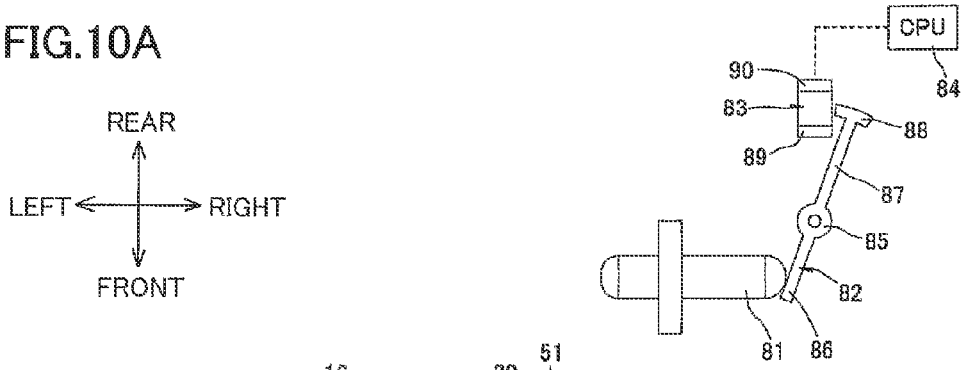
Figure 10B:
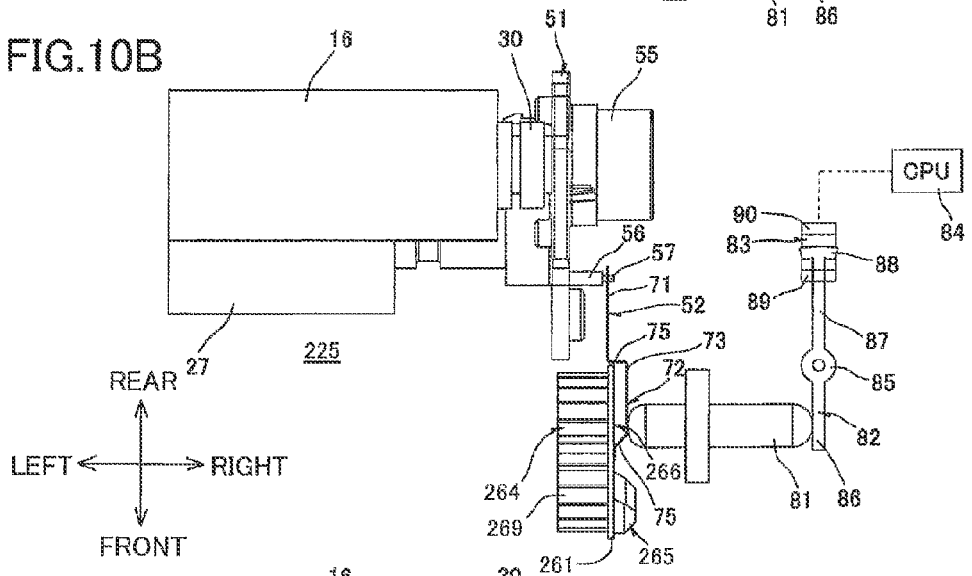
Figure 10C:
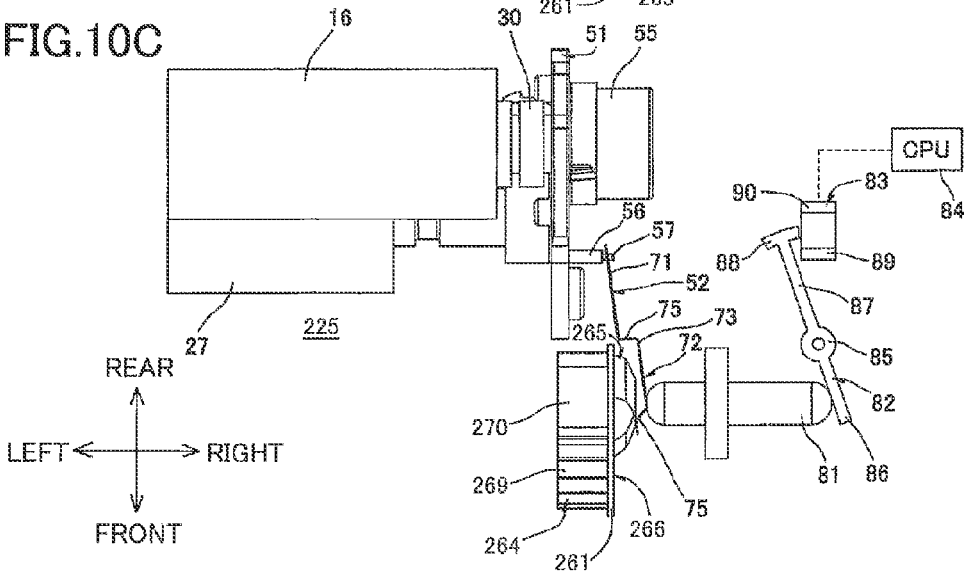

Further, the main electrode 81 is slidably movable in the lateral direction to one of a reference position shown in FIG. 10B, an advanced position shown in FIG. 10A, and a retracted position shown in FIG. 10C. In the reference position, the main electrode 81 is in contact with the cartridge electrode 52 during an image forming operation in the printer 1. In the advanced position, the main electrode 81 is advanced leftward from the reference position. In the retracted position, the main electrode 81 is retracted rightward from the reference position.

Further, the actuator 82 is pivotally movable to one of a first light transmitting position shown in FIG. 10A, a light shielding position shown in FIG. 10B, and a second light transmitting position shown in FIG. 10C. In the first light transmitting position, the abutment lever 86 extends diagonally frontward and leftward while the light shielding lever 87 extends diagonally rearward and rightward. In the light shielding position, the abutment lever 86 and the light shielding lever 87 extend in the frontward/rearward direction. In the second light transmitting position, the abutment lever 86 extends diagonally frontward and rightward while the light shielding lever 87 extends diagonally rearward and leftward. The actuator 82 is normally urged in a clockwise direction in a plan view toward the first light transmitting position by an urging member (not shown), such as a spring.

When the process cartridge 11 (the developing cartridge 225) is not assembled to the main casing 2, the actuator 82 is positioned at the first light transmitting position shown in FIG. 10A by the urging force of the urging member (not shown), so that the main electrode 81 is positioned at the advanced position. In this state, the photo-sensor 83 transmits an ON signal to the CPU 84.

If a predetermined time period has been elapsed while maintaining the advanced position of the main electrode 81, that is, if the ON signal from the photo-sensor 83 is not interrupted within the predetermined time period, the CPU 84 determines that the developing cartridge 225 is not assembled to the main casing 2.

When a new developing cartridge 225 is assembled into the main casing 2, the left end portion of the main electrode 81 is in contact with the main portion 73 of the cartridge electrode 52, as shown in FIG. 10B. Incidentally, when a new developing cartridge 225 is assembled into the main casing 2, the cartridge electrode 52 is positioned at the first position shown in FIG. 10B such that the cartridge electrode 52 is in contact with a part of a base portion 261 of the moving member 253, the part being located downstream of the projection 265 in the counterclockwise direction in a right side view. That is, when a new developing cartridge 225 is assembled into the main casing 2, the cartridge electrode 52 is in confrontation with the first recessed region 266A.

As a result, the main electrode 81 is urged rightward against the urging force of the urging member applied to the actuator 82 from the advanced position to the reference position while the actuator 82 is pivotally moved in the counterclockwise direction in a plan view from the first light transmitting position to the light shielding position.

Thus, output of the ON signal from the photo-sensor 83 to the CPU 84 is interrupted. In other words, the detection unit (the actuator 82 and the photo-sensor 83) detects the first position of the cartridge electrode 52 and the reference position of the main electrode 81. Then, the CPU 84 determines that the main electrode 81 has been moved from the advanced position to the reference position due to interruption of the ON signal from the photo-sensor 83 prior to the warm-up operation.

Figures 1, 9C:
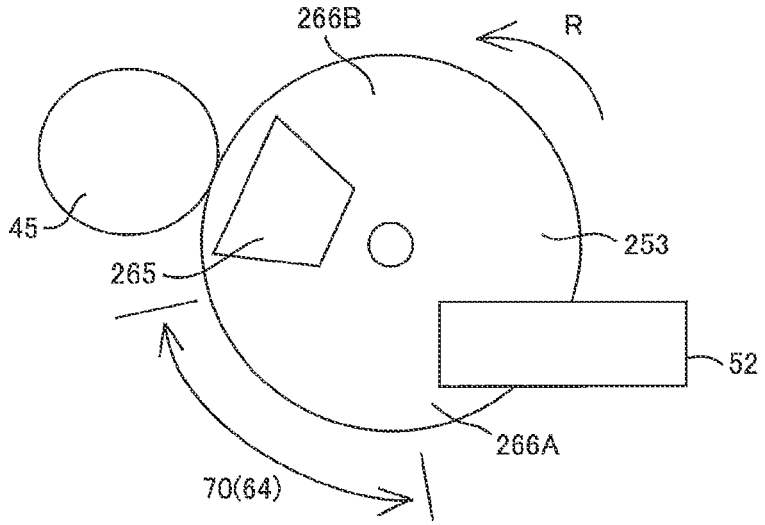
Figures 2, 9C:
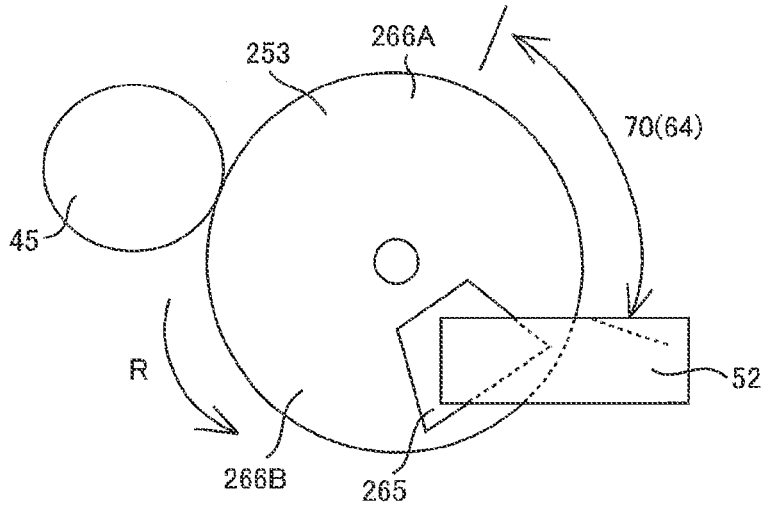
Figures 3, 9C:
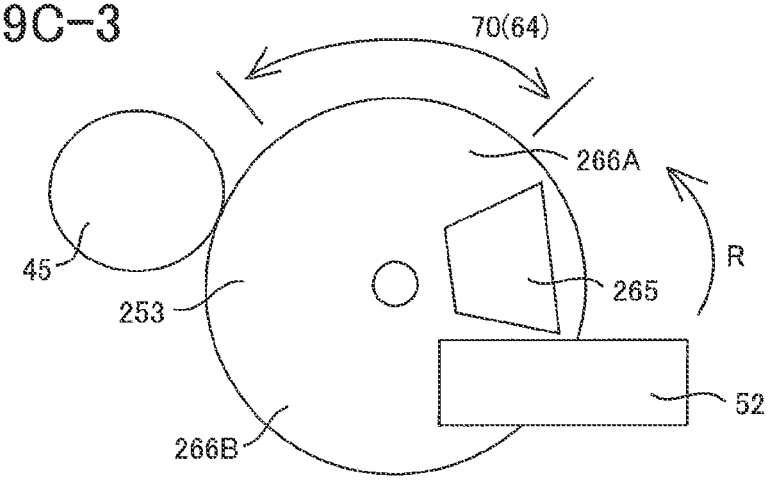

After the developing cartridge 225 is assembled into the main casing 2, the warm-up operation is started, so that the moving member 253 is rotated in the counterclockwise direction in a right side view, as shown in FIG. 9C-1.

Then, the cartridge electrode 52 is relatively moved in the clockwise direction in a right side view from the first recessed region 266A located downstream of the projection 265 in the counterclockwise direction in a right side view, so that the front leg portion 75 of the cartridge electrode 52 which has been seated on the first recessed region 266A is seated onto the projection 265, as shown in FIGS. 9C-2 and 10C, so as to push the main electrode 81 rightward against the urging force of the urging member (not shown) applied to the actuator 82.

As a result, the cartridge electrode 52 is pivotally moved rightward about the rear end portions of the supported portions 71 from the first position to the second position against the urging force of the urging member (not shown) applied to the actuator 82.

At the same time, the main electrode 81 is pushed rightward from the reference position to the retracted position against the urging force of the urging member (not shown) applied to the actuator 82, so that the actuator 82 is pivotally moved in the counterclockwise direction in a plan view from the light shielding position to the second light transmitting position against the urging force of the urging member (not shown).

Thus, the photo-sensor 83 outputs the ON signal to the CPU 84. In other words, the detection unit (the actuator 82 and the photo-sensor 83) detects the second position of the cartridge electrode 52 and the retracted position of the main electrode 81.

Then, the CPU 84 determines that the main electrode 81 has been moved from the reference position to the retracted position upon receipt of the ON signal from the photo-sensor 83 after starting the warm-up operation.

As a result of further rotation of the moving member 253 in the counterclockwise direction in a right side view, as shown in FIG. 9C-3, the cartridge electrode 52 is relatively moved in the clockwise direction in a right side view from the projection 265, so that the cartridge electrode 52 which has been seated on the projection 265 is brought into confrontation with the second recessed region 266B located upstream of the projection 265 in the counterclockwise direction in a right side view. Thus, the cartridge electrode 52 can be pivotally moved leftward.

As a result, the cartridge electrode 52 is pivotally moved leftward about the rear end portions of the support portions 71 from the second position to the first position via the main electrode 81 against the urging force of the urging member (not shown) applied to the actuator 82.

At the same time, the main electrode 81 is moved leftward from the retracted position to the reference position by the urging force of the urging member (not shown) applied to the actuator 82, so that the actuator 82 is pivotally moved in the clockwise direction in a plan view from the second light transmitting position to the light shielding position by the urging force of the urging member (not shown).

Thus, output of the ON signal from the photo-sensor 83 to the CPU 84 is interrupted. That is, the detection unit (the actuator 82 and the photo-sensor 83) detects the first position of the cartridge electrode 52 and the reference position of the main electrode 81.

Then, the CPU 84 determines that the main electrode 81 has been moved from the retracted position to the reference position due to interruption of the ON signal from the photo-sensor 83.

In accordance with further rotation of the moving member 253 in the counterclockwise direction in a right side view, the toothless portion 270 of the chipped gear 264 of the moving member 253 is brought into confrontation with the agitator gear 45, releasing meshing engagement between the toothed portion 269 of the chipped gear 264 and the agitator gear 45. Thus, rotation of the moving member 253 is stopped to terminate the warm-up operation.

The CPU 84 determines that the developing cartridge 225 is a new (unused) cartridge based on the detection of movement of the main electrode 81 from the reference position to the retracted position and then from the retracted position to the reference position after starting the warm-up operation.

Incidentally, the CPU 84 determines assembly of the developing cartridge 225 into the main casing 2 when the ON signal from the photo-sensor 83 is interrupted within the predetermined time period (that is, when the main electrode 81 is judged to be at the reference position).

According to the third embodiment, operations and effects similar to those of the first embodiment can also be obtained.

While the present invention has been described in detail with reference to the embodiments thereof, it would be apparent to those skilled in the art that various changes and modifications may be made therein without departing from the spirit of the present invention.

What is claimed is:

1. A cartridge comprising:

a cartridge frame configured to accommodate therein developing agent, the cartridge frame including a first side wall and a second side wall spaced away from the first side wall and in confrontation with the first side wall in a confronting direction;

a drive input portion provided at one of the first side wall and the second side wall, the drive input portion configured to receive an external driving force;

a cartridge electrode provided at the second side wall and configured to receive external electric power, the cartridge electrode configured to be moved to a first position where the cartridge electrode receives the external electric power and to a second position spaced away from the first position in the confronting direction; and a moving member provided at the second side wall and provided to face the cartridge electrode, the moving member configured to be moved in a moving direction by a predetermined moving amount in response to the external driving force being received by the moving member as a result of an input of the external driving force into the drive input portion, and the moving member configured to move the cartridge electrode to the first position and to the second position, the moving member being provided with a partially toothless gear comprising a toothed portion to which a driving force from the drive input portion is transmittable, and a toothless portion prohibiting transmission of the driving force, the cartridge electrode being positioned at the first position prior to transmission of the driving force to the toothed portion, and moved from the first position to the second position and then from the second position to the first position upon transmission of the driving force to the toothed portion.

2. The cartridge as claimed in claim 1, wherein the confronting direction includes a first confronting direction in a direction from the moving member to the cartridge electrode and a second confronting direction in a direction from the cartridge electrode to the moving member; and wherein the moving member is provided with a projection protruding in the first confronting direction while defining a recessed portion recessed in the second confronting direction, the cartridge electrode being positioned at the first position upon abutment with the projection and positioned at the second position upon confrontation with the recessed portion.

3. The cartridge as claimed in claim 2, wherein at least one of the recessed portion and the cartridge electrode defines a first inclined surface and a second inclined surface, the first inclined surface being inclined in the first confronting direction toward an upstream side in the moving direction of the moving member with respect to the cartridge electrode, and the second inclined surface being inclined in the second confronting direction toward the upstream side.

4. The cartridge as claimed in claim 1, wherein the moving member is rotatable in a rotating direction, the moving direction of the moving member being the rotating direction.

5. The cartridge as claimed in claim 1, wherein the cartridge electrode extends in an orthogonal direction orthogonal to the confronting direction; and wherein the moving member is provided with a maintaining portion configured to maintain the first position of the cartridge electrode after transmission of the driving force to the toothed portion has been terminated.

6. The cartridge as claimed in claim 5, wherein the orthogonal direction includes a first orthogonal direction and a second orthogonal direction opposite to the first orthogonal direction;

wherein the cartridge electrode is provided with a base portion and a rigid portion connected to the base portion, the rigid portion being positioned at a downstream side of the base portion in the first orthogonal direction and having rigidity higher than that of the base portion; and wherein the maintaining portion is configured to support the rigid portion.

7. A cartridge comprising:

a cartridge frame having a developing agent accommodating portion configured to accommodate developing agent therein, the cartridge frame including a first side wall and a second side wall spaced away from the first side wall and in confrontation with the first side wall in a confronting direction, the developing agent accommodating portion being disposed between the first side wall and the second side wall in the confronting direction;

a drive input portion disposed at a position opposite to the developing agent accommodating portion with respect to one of the first side wall and the second side wall and configured to receive an external driving force;

a cartridge electrode disposed at a position opposite to the developing agent accommodating portion with respect to the second side wall and configured to receive external electric power, the cartridge electrode configured to be moved to a first position where the cartridge electrode receives the external electric power and to a second position spaced away from the first position in the confronting direction; and a moving member disposed at a position opposite to the developing agent accommodating portion with respect to the second side wall and provided to face the cartridge electrode, the moving member configured to be moved in a moving direction by a predetermined moving amount in response to the external driving force being received by the moving member as a result of an input of the external driving force into the drive input portion, and the moving member configured to move the cartridge electrode from the first position to the second position and then from the second position to the first position, the moving member being provided with a partially toothless gear comprising a toothed portion to which a driving force from the drive input portion is transmittable, and a toothless portion prohibiting transmission of the driving force, the cartridge electrode being positioned at the first position prior to transmission of the driving force to the toothed portion, and moved from the first position to the second position and then from the second position to the first position upon transmission of the driving force to the toothed portion.

8. The cartridge as claimed in claim 7, wherein the confronting direction includes a first confronting direction in a direction from the moving member to the cartridge electrode and a second confronting direction in a direction from the cartridge electrode to the moving member; and wherein the moving member is provided with a projection protruding in the first confronting direction while defining a recessed portion recessed in the second confronting direction, the cartridge electrode being positioned at the first position upon abutment with the projection and positioned at the second position upon confrontation with the recessed portion.

9. The cartridge as claimed in claim 8, wherein at least one of the recessed portion and the cartridge electrode defines a first inclined surface and a second inclined surface, the first inclined surface being inclined in the first confronting direction toward an upstream side in the moving direction of the moving member with respect to the cartridge electrode, and the second inclined surface being inclined in the second confronting direction toward the upstream side.

10. The cartridge as claimed in claim 7, wherein the moving member is rotatable in a rotating direction, the moving direction of the moving member being the rotating direction.

11. The cartridge as claimed in claim 7, wherein the cartridge electrode extends in an orthogonal direction orthogonal to the confronting direction; and wherein the moving member is provided with a maintaining portion configured to maintain the first position of the cartridge electrode after transmission of the driving force to the toothed portion has been terminated.

12. The cartridge as claimed in claim 11, wherein the orthogonal direction includes a first orthogonal direction and a second orthogonal direction opposite to the first orthogonal direction;

wherein the cartridge electrode is provided with a base portion and a rigid portion connected to the base portion, the rigid portion being positioned at a downstream side of the base portion in the first orthogonal direction and having rigidity higher than that of the base portion; and wherein the maintaining portion is configured to support the rigid portion.

* * * * *